US006481826B1

(12) United States Patent
Hara et al.

(10) Patent No.: US 6,481,826 B1
(45) Date of Patent: Nov. 19, 2002

(54) INK JET RECORDING APPARATUS, METHOD OF DISCHARGING INK FROM CAPPING UNIT INCORPORATED IN THE APPARATUS, AND INK COMPOSITION USED WITH THE APPARATUS

(75) Inventors: Kazuhiko Hara, Nagano (JP); Hitoshi Hayakawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/657,654

(22) Filed: Sep. 7, 2000

(30) Foreign Application Priority Data

| | | |
|---|---|---|
| Sep. 7, 1999 | (JP) | 11-253507 |
| Sep. 7, 1999 | (JP) | 11-253508 |
| Jul. 18, 2000 | (JP) | 2000-217696 |
| Aug. 8, 2000 | (JP) | 2000-240061 |

(51) Int. Cl.[7] ..... B41J 2/165
(52) U.S. Cl. ..... 347/29; 347/30
(58) Field of Search ..... 347/29, 7, 100, 347/30, 31, 32, 33, 22, 23

(56) References Cited

U.S. PATENT DOCUMENTS

| | | | | |
|---|---|---|---|---|
| 4,682,183 A | * | 7/1987 | Elchinger et al. | 347/90 |
| 5,670,997 A | * | 9/1997 | Sugimoto et al. | 347/30 |
| 5,717,444 A | | 2/1998 | Sugimoto et al. | 347/29 |
| 5,956,053 A | * | 9/1999 | Michael | 347/29 |
| 5,988,792 A | * | 11/1999 | Okazaki et al. | 347/44 |
| 6,010,203 A | * | 1/2000 | Muraki | 347/30 |
| 6,017,109 A | * | 1/2000 | Saijo | 347/30 |
| 6,234,601 B1 | * | 5/2001 | Hayashi et al. | 347/16 |

FOREIGN PATENT DOCUMENTS

| | | | | |
|---|---|---|---|---|
| EP | 0 698 495 A2 | * | 2/1996 | |
| EP | 0 867 295 A2 | | 9/1998 | B41J/2/165 |
| JP | 357197308 A | * | 12/1982 | |
| JP | 5104731 A | * | 4/1993 | |
| WO | 91/14576 | | 10/1991 | B41J/2/165 |

OTHER PUBLICATIONS

Japanese Abstract No. 62271749 dated Nov. 26, 1987, Hideki.

Europe Search Report, EP 00119332, De Groot, R Mar. 9, 2001.

* cited by examiner

*Primary Examiner*—John Barlow
*Assistant Examiner*—Shih-wen Hsieh
(74) *Attorney, Agent, or Firm*—Sughrue Mion, PLLC

(57) ABSTRACT

A recording head has a nozzle formation face provided with nozzle orifices from which ink drops are jetted to print on a recording medium in accordance with print data. A capping unit has an internal space communicated with a negative pressure generator, and an opening for sealing the nozzle formation face and sucking ink from the nozzle orifices into the internal space by negative pressure generated by the negative pressure generator. An ink discharge port is formed on a bottom portion of the internal space of the capping unit. An ink leader is provided in the capping unit so as to generate capillary action to lead the sucked ink toward the ink discharge port.

15 Claims, 19 Drawing Sheets

INK JET RECORDING APPARATUS, METHOD OF DISCHARGING INK FROM CAPPING UNIT INCORPORATED IN THE APPARATUS, AND INK COMPOSITION USED WITH THE APPARATUS

BACKGROUND OF THE INVENTION

This invention relates to an ink jet recording apparatus comprising a recording head for jetting ink drops from nozzle orifices based on print data, thereby printing on recording paper. Particularly, this invention to an ink jet recording apparatus that can prevent a print failure from occurring by suppressing volatilization of an ink solvent from the recording head during a suspend mode of the recording apparatus in order to avoid the influence of bubbles that can occur due to the surface tension of the ink solvent.

The ink jet recording apparatus is used for various types of print including color print in these days because print noise is comparatively small and moreover small dots can be formed at a high density.

The ink jet recording apparatus comprises an ink jet recording head for receiving ink supplied from an ink cartridge and a paper feeder for moving recording paper relatively to the recording head and jets ink drops onto recording paper for recording while moving the recording head on a carriage in the width direction of the recording paper.

The recording head capable of jetting black ink and color inks of yellow, cyan, and magenta is mounted on the carriage, enabling not only text print in black ink, but also full color print by changing the content percentage of the respective color inks.

Since ink pressurized in pressure generation chambers is jetted to recording paper as ink drops from nozzle orifices for printing, the recording head installed in the recording apparatus involves the problem of causing a print failure to occur because of a rise in the ink viscosity or hardening of ink caused by evaporation of an ink solvent from the nozzle orifices, deposition of dust, mixing of bubbles into an ink flow passage, or the like.

Thus, this kind of ink jet recording apparatus comprises a capping unit for sealing the nozzle formation face of the recording head in non-print mode (suspend mode) and a wiping member for wiping out and cleaning the nozzle formation face as required.

The capping unit serves as a lid for preventing ink in the nozzle orifices from being dried in the suspend mode of print; it: can suppress clogging caused by drying ink in the nozzle orifices of the recording head for providing the reliability of the print operation at the restart time of print.

Further, the capping unit also serves as a cleaner unit for sealing the nozzle formation face and sucking and discharging ink from the nozzle orifices by negative pressure generated by a suction pump, thereby resolving an ink jet failure caused by clogging caused by ink hardening in the nozzle orifices or mixing of bubbles into the ink flow passage.

To make the capping unit function effectively as a lid for preventing ink in the nozzle orifices from being dried during quiescent operation of print as described above, the related recording apparatus adopts a control sequence of jetting a predetermined amount of ink into the capping unit from the recording head just before the capping operation.

On the other hand, the capping unit stores an ink absorption material of a porous foam formed like a sheet on the inner bottom of the capping unit formed like a rectangle and ink is held by the ink absorption material, thereby maintaining the internal space of the capping unit in a wet state with the nozzle formation face sealed.

By the way, in addition to a water content, polyhydric alcohol such as glycerine or diethylene glycol as a humectant is mixed in print ink for maintaining the inside of the capping unit in a wet state.

The polyhydric alcohol has a nature of absorbing (retaining) water from the air and is used as an ink solvent to suppress an increase in viscosity of ink and hardening of ink for preventing clogging mainly in the minute nozzle orifices of the recording head.

However, in a state in which the ink absorption material of a porous foam is placed in the capping unit as described above, the water content is evaporated from the ink absorption material with the passage of time, but the above-mentioned humectant is left in the ink absorption material and the composition percentage rises gradually with the passage of the use time of the recording apparatus.

Therefore, if the humectant is left in the ink absorption material in a high composition percentage, it absorbs the water content in the internal space in the capped state of the recording head, developing a problem of drying ink in the nozzle orifices of the recording head.

Focusing attention on the adverse effect of the humectant contained in print ink and from the viewpoint, it is a first object of the invention to provide a structure wherein the ink absorption material placed on the inner bottom of the capping unit is removed and to suck and discharge ink from the recording head, the ink can be discharged promptly so that it is not left in the capping unit, and provide an ink jet recording apparatus comprising a capping unit in which a high-density humectant is not accumulated and moreover an adequately wet state can be maintained by the water content contained in the ink and make it possible to ensure reliability of print of a recording head.

On the other hand, in the structure wherein the ink absorption material placed on the inner bottom of the capping unit is removed, as described above, if sealing of the nozzle formation face of the recording head with the capping unit is released, a large bubble shaped like a so-called soup bubble appears by the surface tension of an ink solvent between the seal face of the capping unit and the nozzle formation face of the recording head; this is a problem.

It is considered that a bubble occurs because a porous member as an ink absorption member does not exist and the inside. of the capping unit is formed as comparatively smooth faces.

FIGS. 33 to 36 schematically show the situation in order. FIG. 33 shows a state in which the nozzle formation face of the recording head is sealed with the capping unit. FIGS. 34 to 36 show with the upper half part shown in FIG. 33 not shown how the above-mentioned large bubble shaped like a so-called soup bubble is left in the capping unit as sealing of the nozzle formation face of the recording head with the capping unit is released.

Identical components shown in FIGS. 33 to 36 are denoted by the same reference numerals.

First, as shown in FIG. 33, a nozzle plate 12*a* forming a nozzle formation face 12*a* of a recording head 12 is placed on the bottom face of a head case 12*b* forming a part of the recording head 12 and is formed with a plurality of nozzle orifices 12*c*. Actuators 12*d*, for example, implemented as piezoelectric vibrators are placed in the head case 12*b* in a one-to-one correspondence with the nozzle orifices 12*c*.

Communication channels 12*e* are formed in the head case 12*b* from the nozzle orifices 12*c* and the actuators 12*d* to the top thereof.

Four hollow ink introduction needles 41 are placed upright on the top of the head case 12*b* and the communication channels 12*e* formed in the head case 12*b* are made to communicate with hollow passages of the ink introduction needles 41.

An ink introduction hole (not shown) is made in the vicinity of the crest of each ink introduction needle 41 and ink from an ink cartridge is introduced through each ink introduction hole into the corresponding ink introduction needle 41 and is supplied via the communication flow passage 12*e* to the actuator 12*d* of the recording head 12.

The ink introduction needle 41 at the left end shown in FIG. 33 is provided for receiving black ink and a black ink cartridge 7 is attached toward the ink introduction needle 41 at the left end from the top.

A color ink cartridge 8 stores color inks of cyan, magenta, and yellow separately in order from left to right in FIG. 33 and is also attached toward the three remaining ink introduction needles 41 from the top as shown in FIG. 33.

On the other hand, the capping unit 9 is made up of a holder 21 and a cap member 22 of a rubber material, etc., having an end face formed almost like a square, the cap member 22 being placed on the top face of the holder 21. The holder 21 is housed in a slider 43 that can be moved up and down with a circular art path via a link arm 42.

An engagement projection 9*e* is placed at an end part of the slider 43 and abuts a part of the head case 12*b* as a carriage on which the recording head 12 is mounted is moved to the home position side (right in the figure), and the nozzle formation face 12*a* of the recording head 12 is sealed with the cap member 22 moved up through the link arm 42.

From the seal state of the nozzle formation face 12*a* with the capping unit 9 shown in FIG. 33, the carriage is moved a little to the print area side (left in FIG. 34) as shown in the figure, whereby the capping unit 9 is moved down through the link arm 42, whereby the sealing of the nozzle formation face 12*a* with the capping unit 9 is released.

When a slight gap occurs between the nozzle formation face 12*a* and the capping unit 9, a film Bu is formed in the gap by the surface tension of ink discharged into the capping unit 9.

In the structure of the capping unit 9 shown in the example, if the capping unit 9 is furthermore moved down as shown in FIG. 35, it is inclined a little to the print area side, namely, is brought out of contact with the nozzle formation face 12*a* in an unparallel state therewith.

Therefore, the film Bu generated by the surface tension of ink solvent is moved in the right direction in the figure where the spacing between the capping unit 9 and the nozzle formation face 12*a* is narrow, and grows to a large bubble Bu shaped like a so-called soup bubble.

As shown in FIG. 36, the carriage on which the recording head 12 is mounted is further moved to the print area side, whereby the large bubble Bu is left in the capping unit 9.

If the nozzle formation face 12*a* of the recording head 12 is again sealed in the state in which the large bubble shaped like a soup bubble is thus left in the capping unit 9, the large bubble Bu disappears and at the instant, a meniscus of ink formed in the nozzle orifice is destroyed; this is a problem. Thus, an ink drop cannot normally be jetted through the nozzle orifice, namely, a print failure of a missing dot occurs.

Particularly, in recent years, higher-precision print quality has been required increasingly and there has been a tendency to use ink using a pigment, for example. In such ink using a pigment, the surface tension is comparatively large and particularly bubbles easily occur.

It is therefore a second object of the invention to provide an ink jet recording apparatus for making it possible to avoid a print failure caused by occurrence of a large bubble shaped like a soup bubble or aggressively prevent a large bubble from occurring and an ink composition suited to the ink jet recording apparatus, thereby preventing occurrence of a print failure of a missing dot, etc., and ensuring reliability of print of a recording head.

SUMMARY OF THE INVENTION

To accomplish the above-mentioned object, according to the invention, there is provided an ink jet recording apparatus comprising:

a recording head having a nozzle formation face provided with nozzle orifices from which ink drops are jetted to print on a recording medium in accordance with print data;

a capping unit having an internal space communicated with a negative pressure generator, and having an opening for sealing the nozzle formation face and sucking ink from the nozzle orifices into the internal space by negative pressure generated by the negative pressure generator;

an ink discharge port formed on a bottom portion of the internal space of the capping unit; and an ink leader provided in the capping unit so as to generate capillary action to lead the sucked ink toward the ink discharge port.

Preferably, a pair of slopes are formed in the internal space so as to extend from the opening toward the bottom portion. The ink leader is provided as a valley line defined as an intersection of the slopes. The ink discharge port is formed on a part of the valley line.

In this case, preferably, the opening is formed into a rectangular shape. The valley line extending in a longitudinal direction of the rectangular opening.

Preferably, a groove is formed along the valley line.

Alternatively, the ink leader is provided as a plurality of grooves formed on the bottom portion of the internal space so as to extend toward the ink discharge port.

In this case, preferably, the width of each groove is gradually narrowed toward the ink discharge port.

Alternatively, the ink leader is provided as a plurality of protruded ribs formed on the bottom portion of the internal space so as to extend toward the ink discharge port.

In this case, preferably, the width of each gap defined between the protruded ribs is gradually narrowed toward the ink discharge port.

In the above cases, preferably, water-repellent treatment is applied to surfaces of the internal space.

In the above cases, preferably, a method of discharging ink comprises the steps of:

sealing the nozzle formation face with the capping unit;

driving the negative pressure generator to suck ink from the nozzle orifice into the internal space of the capping unit;

separating the capping unit from the nozzle formation face; and driving the negative pressure generator to discharge the sucked ink from the ink discharge port such that the discharging speed is controlled such an extent that no suction vortex appears in the sucked ink.

According to the above configurations, the ink sucked into the capping unit is promptly led to the ink discharge port by the ink leader presenting capillary action without remaining in the capping unit.

Therefore, accumulating and gradually leaving the above-mentioned humectant contained in ink in the capping unit at high density can be suppressed and a problem of absorbing and hardening the ink solvent (water content) in the nozzle orifices of the recording head can be circumvented.

In this case, ink discharged from the nozzle orifices can be led more smoothly to the ink discharge port by applying water-repellent treatment to the inner face of the capping unit as described above.

To use the ink discharge method in combination, ink is discharged from the capping unit at low suction speed to such an extent that a suction vortex is not formed on an ink surface above the ink discharge port, thus the liquid level of the ink in the capping unit is uniformly lowered and a little ink last left is also pulled into the ink discharge port by the action of the surface tension and the probability of leaving ink in the capping unit can be decreased drastically.

In order to accomplish the second object more perfectly in addition to the first object, according to the invention, a method of discharging ink comprises the steps of:

sealing the nozzle formation face with the capping unit;

driving the negative pressure generator to suck a first amount of ink from the nozzle orifice into the internal space of the capping unit;

separating the capping unit from the nozzle formation face;

driving the negative pressure generator to discharge the sucked ink from the internal space of the capping unit;

sealing again the nozzle formation face with the capping unit; and driving the negative pressure generator to suck a second amount of ink, which is smaller than the first amount, from the nozzle orifice in order to restore a meniscus of ink in each of the nozzle orifices.

In order to execute the above method, the ink jet recording apparatus further comprises a controller for causing the negative pressure generator to apply the negative pressure to the ink discharge port in order to:

(1) suck a first amount of ink from the nozzle orifices when the capping unit seals the nozzle formation face;

(2) suck a second amount of ink, which is smaller than the first amount, from the nozzle orifices when the capping unit seals the nozzle formation face; and (3) suck ink remained in the internal space when the capping unit is apart from the nozzle formation face.

Preferably, the capping unit is separated from the nozzle formation face in an unparallel attitude with respect to the nozzle formation face in accordance with a predetermined movement of the recording head. The ink discharge port is placed at an end portion of the bottom portion of the internal space which is closer to the nozzle formation face when the capping unit starts to be separated from the nozzle formation face.

Alternatively, the capping unit is separated from the nozzle formation face in a parallel attitude with respect to the nozzle formation face in accordance with a predetermined movement of the recording head. A pair of ink discharge ports are placed at both end portions of the bottom portion of the internal space.

Alternatively, the ink jet recording apparatus further comprises a projection for breaking bubbles appearing due to surface tension of an ink solvent.

In this case, preferably, the opening of the capping unit is formed into a rectangular shape. A pair of slopes are formed in the internal space so as to extend from the opening toward the bottom portion such that a valley line defined as an intersection of the slopes extends in a longitudinal direction of the rectangular opening. The projection is formed on each of the slopes.

In the above cases, preferably, an ink composition of the ink contains 0.2–1.5 wt % of a surfactant.

According to the above configurations, ink is sucked from the nozzle orifices of the recording head by executing the cleaning operation, then ink in the capping unit is discharged by the idle suction operation. Then, again the small suction operation of ink from the recording head is executed.

Therefore, a large bubble shaped like a so-called soup bubble appears by the surface tension of ink discharged by the initial suction operation. When capping is again executed, a meniscus of ink in the nozzle orifice is destroyed accordingly, but can be restored to the former state by later executing the small suction operation of ink.

In the executed small suction operation of ink, the remaining ink amount in the capping unit is only a little and therefore the degree of again generating a large bubble shaped like a soup bubble can be lessened extremely.

In the recording apparatus wherein the capping unit is brought out of contact with the nozzle formation face in the unparallel attitude with the nozzle formation face of the recording head, according to the above-described configuration, air in a large bubble shaped like a soup bubble can be positively discharged by executing the suction operation.

Thus, the soup bubble is shrunk and occurrence of a print failure caused by the large bubble can be avoided.

Also in the recording apparatus wherein the capping unit is brought out of contact with the nozzle formation face in an almost parallel attitude with the nozzle formation face of the recording head, according to the above-described configuration, air in a large bubble shaped like a soup bubble can be positively discharged by executing the suction operation. Thus, the soup bubble is shrunk and occurrence of a print failure caused by the large bubble can be avoided.

Further, also in the recording apparatus wherein a projection is formed in the capping unit, a large bubble appearing by the surface tension of an ink solvent can be made to disappear or hard to occur in the presence of the projection, and occurrence of a print failure can be avoided.

In a case where predetermined amount of a surfactant is contained in the ink composition used with the recording apparatus, the degree of generating a large bubble shaped like a soup bubble can be decreased, and occurrence of a print failure can be avoided more efficiently with the synergistic effect with the effect of the above described configurations.

According to the present invention, there also may be adopted a configuration that the capping unit includes a holder member which defines. at least the opening and the bottom portion of the internal space thereof, and a seal member held by the opening, which is to be abutted against the nozzle formation face.

In this case, preferably, the holder member and the seal member are made of materials different with each other.

Preferably, the holder member is made of a synthetic resin material, and the seal member is made of a rubber material.

Alternatively, the holder member includes an inner shell portion which defines the internal space and an outer shell portion integrally formed with the inner shell portion so as to surround the inner shell portion. The seal member is formed between the inner shell portion and the outer shell portion integrally therewith.

In the above cases, preferably, an interior angle between the slopes is 160 degrees or less.

Alternatively, a cross section of the slopes is curved.

In the above cases, a surface roughness of the bottom portion of the internal space is 25 $\mu$m or less.

According to the above configurations, ink sucked into the capping unit is smoothly led to the ink discharge port by the ink leader presenting capillary action without remaining in the capping unit.

Therefore, accumulating and gradually leaving the above-mentioned humectant contained in ink in the capping unit at high density can be avoided and a problem of absorbing and hardening the ink solvent (water content) in the nozzle orifices of the recording head can be circumvented.

In this case, ink discharged from the nozzle orifices can be led more smoothly to the ink discharge port by applying water-repellent treatment to the inner face of the capping unit as described above and the inner bottom face of the capping unit has surface roughness set within the above-mentioned numeric value, whereby the remaining degree of ink on the inner bottom face of the capping unit can be furthermore decreased.

Thus, if the interior angle formed by the pair of slopes inclined from the opening of the capping unit to the bottom of the internal space of the capping unit is made comparatively large, the remaining degree of ink on the inner bottom face of the capping unit can be decreased, so that the outer dimensions of the capping unit, particularly the dimension in the height direction can be lessened.

Since the dimension from the opening of the capping unit to the bottom of the internal space is also lessened accordingly, the degree of separating ink into minute drops and changing to fog (ink mist) in the flushing operation of idly jetting ink toward the capping unit can be decreased.

Therefore, the subsidiary effect of making it possible to decrease occurrence of contamination caused by occurrence of the ink mist can also be expected.

On the other hand, since the holder member and the seal member are made of different materials, occurrence of bubbles caused by the surface tension of ink can be decreased because they differ in interfacial state, and the degree of occurrence of a print failure caused by occurrence of a bubble can be decreased.

According to the present invention, there also may be adopted a configuration that the ink leader includes a slope continuously extending from the opening to the ink discharge port, and a liquid retainer formed on a communication path between the ink discharge port and the negative pressure generator.

In this case, preferably, the liquid retainer is provided as a plurality of ribs protruded from an inner face of the communication path.

Alternatively, the liquid retainer is provided as a plurality of grooves formed on an inner face of the communication path.

Alternatively, the liquid retainer is provided as a liquid absorbing member provided at a connecting portion of the ink discharge port and the communication path.

Alternatively, the liquid retainer is provided as a plurality of thin tubes formed in the communication path so as to extend therealong.

In the above cases, preferably, water-repellant treatment is applied to the slope formed in the capping unit and hydrophilic treatment is applied to the liquid retainer.

According to the above configurations, ink sucked from the nozzle orifices flows into the ink discharge port along the smooth slope without accumulating.

When the suction operation is performed by the negative pressure generator, ink is discharged to the outside without being left by the liquid retainer placed in the communication path between the negative pressure generator and the ink discharge port.

Therefore, the problem of accumulating the above-mentioned humectant contained in ink in the internal space of the capping unit at high density can be solved.

Since the liquid retainer placed in the communication path holds ink jetted from the recording head just before the capping time, the water content contained in the ink can maintain the internal space of the capping unit at high humidity and efficiently suppress evaporation of ink in the nozzle orifices.

In this case, the water-repellent treatment is applied to the slope formed from the opening in the capping unit to the ink discharge port, whereby ink jetted from the nozzle orifices can be smoothly led from the slope to the ink discharge port.

The hydrophilic treatment is applied to the liquid retainer placed in the pipe line communicating with the negative pressure generator from the ink discharge port, whereby the ink holding effect of the liquid retainer by the capillary action can be more increased.

That is, to suck and discharge ink from the recording head in the cleaning operation, ink in the capping unit can be discharged reliably. If the flushing operation of applying a drive signal not involved in print to the recording head for idly jetting ink drops to the inside of the capping unit is executed, ink replenished by the flushing operation can be held in the liquid retainer and the water content contained in the ink jetted by the flushing operation can maintain the internal space of the capping unit at high humidity.

DETAILED DESCRIPTION OF THE PREFERRED EMBODIMENTS

Referring now to the accompanying drawings, there are shown preferred embodiments of ink jet recording apparatus according to the invention.

Figure 1:
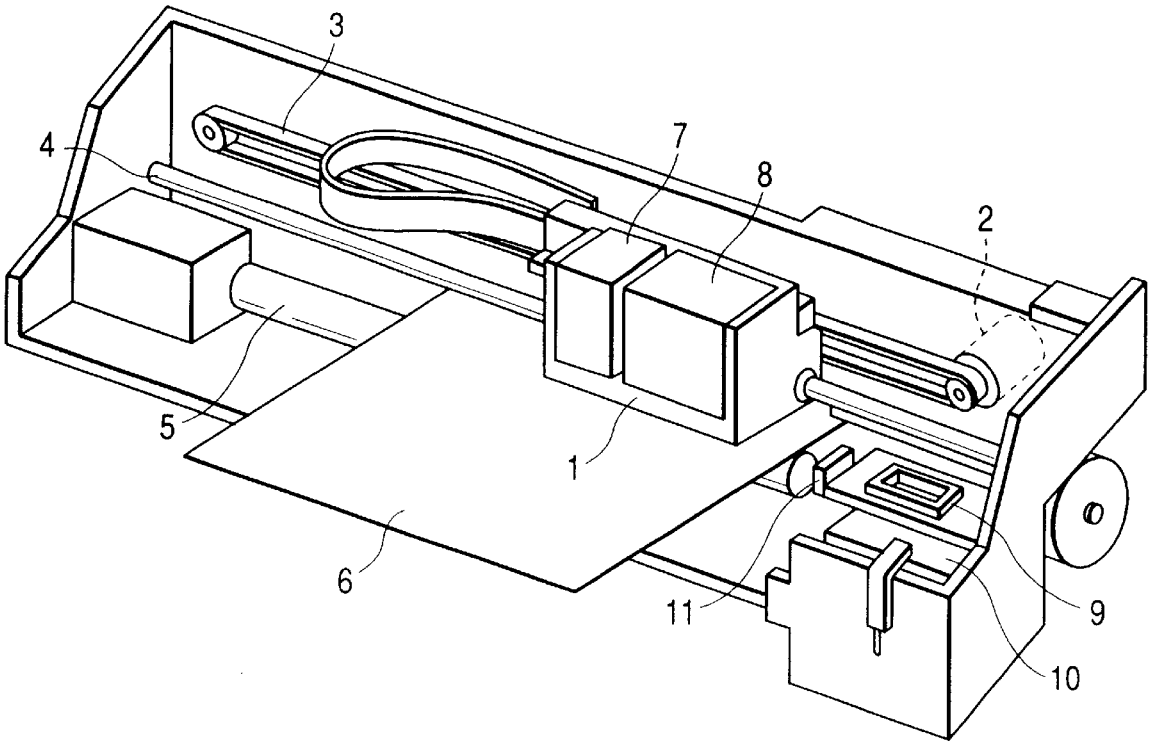
FIG. 1 is a perspective view to show the basic configuration of a recording apparatus main body incorporating the invention.

FIG. 1 is a perspective view to show the basic configuration of a recording apparatus main body incorporating the invention. In FIG. 1, numeral 1 denotes a carriage. The carriage 1 is guided by a guide member 4 via a timing belt 3 driven by a carriage motor 2 and is reciprocated in the axial direction of a platen 5.

An ink jet recording head (described later) is mounted on the lower side of the carriage 1 facing recording paper 6 and a black ink cartridge 7 and a color ink cartridge 8 for supplying ink to the recording head are detachably placed on the top of the carriage 1.

Numeral 9 denotes a capping unit placed in a non-print area (home position). When the recording head moves just above the capping unit 9, the capping unit 9 can advance above for sealing the nozzle formation face of the recording head. Placed below the capping unit 9 is a suction pump 10 as a negative pressure generator for giving negative pressure to the internal space of the capping unit 9.

The capping unit 9 serves as a lid for sealing the nozzle formation face of the recording head for suppressing evaporation of an ink solvent from nozzle orifices during quiescent operation of the recording apparatus, serves as an ink receptacle at the flushing operation time of applying a drive signal not involved in print to the recording head for idly jetting ink drops, and also performs the operation of a cleaning function of applying negative pressure from the suction pump 10 to the recording head for sucking and discharging ink.

As shown in FIG. 1, a wiping member 11 made of an elastic plate of a rubber material, etc., is placed in a print area adjacent to the capping unit 9. When the carriage 1 is moved to the capping unit 9 side, the wiping member 11 performs the wiping operation of wiping out and cleaning the nozzle formation face of the recording head.

Figure 2:
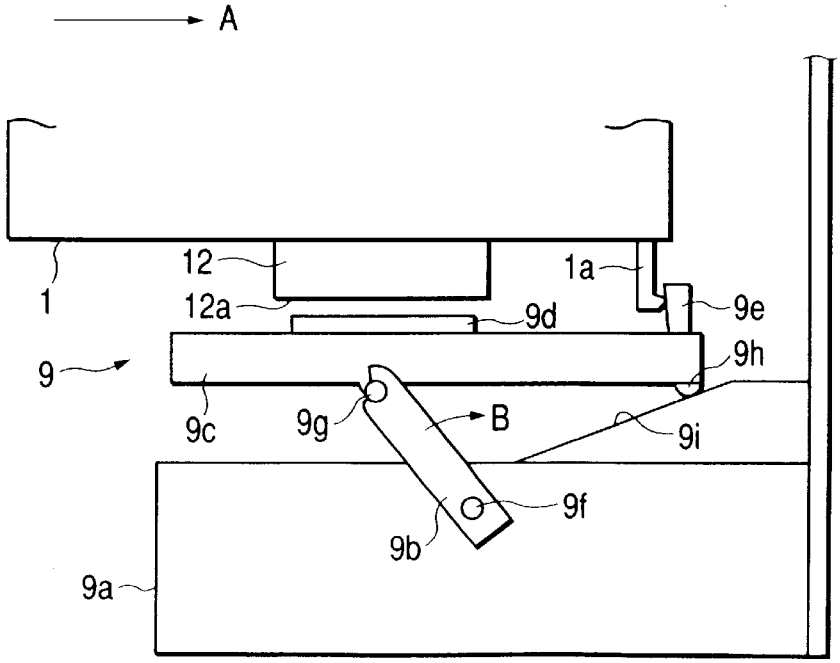
FIG. 2 is a schematic drawing to show a schematic configuration of an elevator of a capping unit installed in the recording apparatus shown in FIG. 1.

FIG. 2 is a schematic drawing to show an example of an elevator mechanism of the capping unit 9 with a move of the carriage 1. In the figure, numeral 1 denotes the above-mentioned carriage, and a recording head 12 is mounted on the lower side of the carriage 1. A projection la is placed at the front end part in the advance direction of the carriage 1 to the home position.

On the other hand, the capping unit 9 comprises a slider 9*c* that can be moved up and down with a circular arc path via a link arm 9*b* relative to a base 9*a*, and a cap member 9*d* of a rubber material, etc., having an end face formed almost like a square is placed on the top of a holder (described later) housed in the slider 9*c*.

A stopper 9*e* is placed on the top of the slider 9*c*, against which the projection 1*a* on the carriage is to be abutted.

The link arm 9*b* is journaled by a support shaft 9*f* on the base 9*a* side and the slider 9*c* is journaled by a support shaft 9*g* on the free end side of the link arm 9*b*. Further, a protrusion 9*h* is formed on the lower side of an end part of the slider 9*c* and is slid along a slope 9*i* formed on the base 9*a*.

Therefore, if the carriage 1 is moved to the home position, namely, in the arrow A direction, the projection la on the carriage 1 abuts against the stopper 9*e* on the capping unit 9, and the carriage 1 is furthermore advanced in the arrow A direction, whereby the link arm 9*b* supporting the slider 9*c* is rotated in the arrow B direction. The projection 9*h* formed on the lower side of the end part of the slider 9*c* is slid along the slope 9*i* formed on the base 9*a*.

Thus, the slider 9*c* is moved to the top while it holds the almost horizontal attitude as the carriage 1 is advanced, whereby a nozzle formation face 12*a* of the recording head 12 is sealed with the cap member 9*d* placed on the slider 9*c* and is placed in a capped state.

In the capped state, the carriage 1 is locked by a carriage lock mechanism (not shown) and the capped state is maintained. To start the print operation, the carriage lock mechanism is canceled and the carriage 1 is moved in an opposite direction to the arrow A direction by the carriage motor 2, so that the slider 9*c* is moved down by the action of a return spring (not shown).

Figure 3:
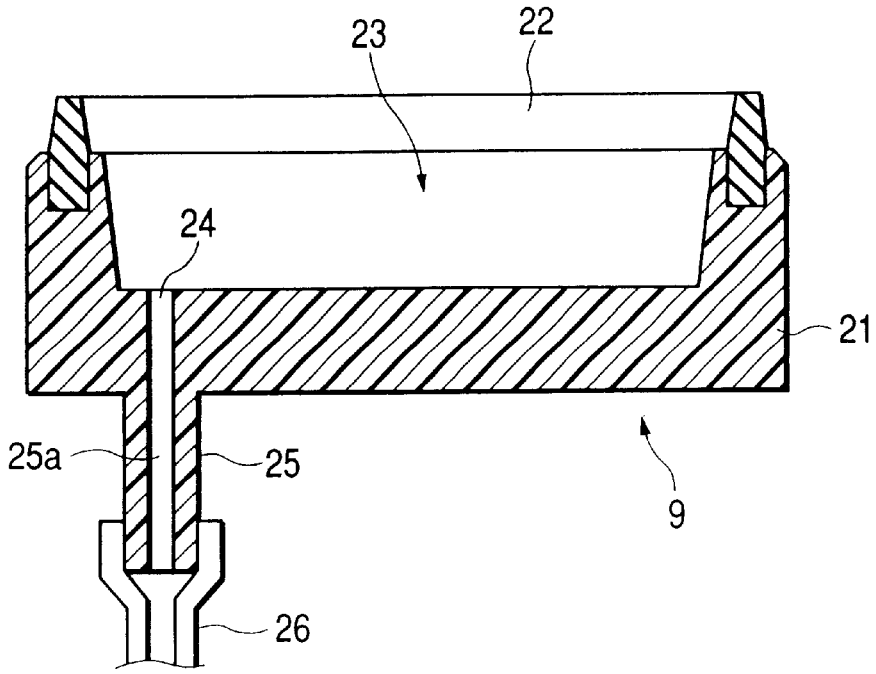
FIG. 3 is a longitudinal sectional view to show a capping unit placed in the recording apparatus according to a first embodiment of the invention.
Figure 4:
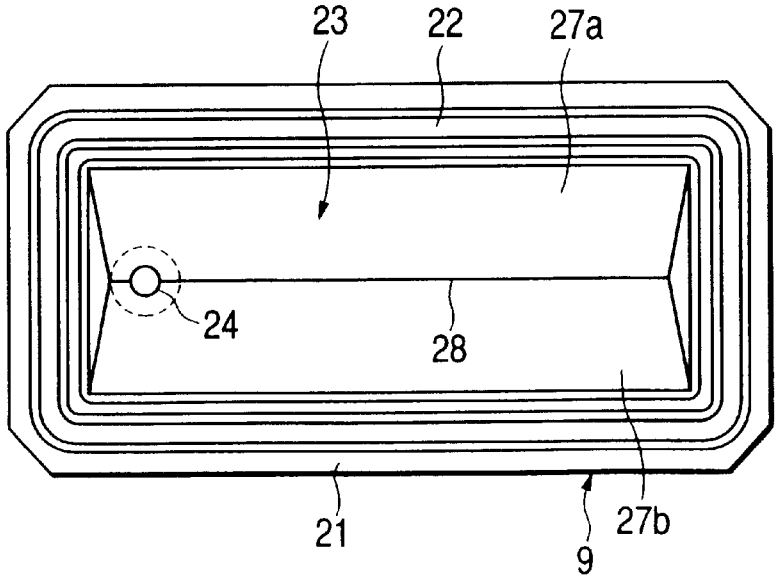
FIG. 4 is a plan view of the capping unit shown in FIG. 3.

FIGS. 3 and 4 show a capping unit placed in the recording apparatus according to a first embodiment of the invention. FIG. 3 is a longitudinal sectional view of the capping unit and FIG. 4 is a plan view of the capping unit from the top face.

The capping unit 9 is made up of a holder 21 formed almost like a rectangular parallelepiped and a cap member 22 of a rubber material, etc., having an end face formed almost like a square, the cap member 22 being placed on the top face of the holder 21.

The cap member 22 is attached to the holder 21 in a state in which it is buried along the margins of the top face of the holder 21 as shown in FIG. 3. The cap member 22 is identical with the cap member 9*d* previously described with reference to FIG. 2.

The cap member 22 forms an opening for sealing the nozzle formation face 12 of the recording head 12.

The holder 21 is molded of a synthetic resin, for example, and is formed with an internal space 23 and formed in a bottom with an ink discharge port 24 as shown in FIG. 3.

On the bottom face of the holder 21 formed with the ink discharge port 24, a suction pipe 25 is molded integrally with the holder 21 and the ink discharge port 24 is made to communicate with a pipe line 25*a* formed in the suction pipe 25.

A tube 26 is connected to a lower end part of the suction pipe 25 and is connected to the suction pump 10 provided as a negative pressure generator.

As shown in FIG. 4, the capping unit 9 is formed with an opening like a rectangle and a pair of slopes 27*a* and 27*b* inclined from the opening to the bottom along the long side direction of the rectangle.

A part of a valley line 28 which is shaped like V in cross section, formed by the pair of slopes 27*a* and 27*b* which cross each other touches the ink discharge port 24.

The valley line 28 formed by the pair of slopes 27*a* and 27*b* provides an ink leader for giving capillary action to ink remaining along the valley line 28, whereby the ink remaining along the valley line 28 is led toward the ink discharge port 24 contacting the valley line 28.

Preferably, water-repellent treatment is applied to the inner faces of the capping unit 9, particularly, the pair of slopes 27*a* and 27*b*. By applying water-repellent treatment to the slopes 27*a* and 27*b*, if ink is discharged by the capping unit 9 as described later, it does not stick to the slope 27*a*, 27*b* to which water-repellent treatment is applied, and smoothly moves to the valley line 28 forming the ink leader as the ink is made spherical by the surface tension.

In order to apply the water-repellent treatment, a high water-repellent material may be used for the material of the holder 21, or a post-treatment, for example, with a fluorine-containing polymer, may be conducted particularly for the slopes 27*a* and 27*b* of the holder 21.

To use a high water-repellent material as the material of the holder 21, the water repellency can be maintained good by using a high polymer resin such as polypropylene or polyacetal.

To conduct post-treatment with a fluorine-containing polymer, a fluorine-containing polymer such as polydiper fluoroalkyl fumarate, Teflon AF (trademark of E.I. Du Pont de Nemours & Company), or Cytop (trademark of Asahi Glass Co., Ltd.), or an alternating copolymer of fluorine-containing ethylene and hydrocarbon family ethylene such as an alternating copolymer of polydiper fluoroalkyl fumarate and styrene, an alternating copolymer of trifluoroethylene chloride and vinyl ether, or an alternating copolymer of tetrafluoroethylene chloride and vinyl ester, or an analog or a derivative, Fumalite (trademark of NOF Corporation) can be used preferably. As a specific example, to use the Cytop, the holder 21 is immersed in a 3% solution of Cytop CTX-100A and is pulled up, then is dried for about one hour, for example, in an atmosphere at 90° C., whereby a water-repellant layer can be formed on a surface of the holder 21.

It is also effective to apply water-repellent treatment to the cap member 22. In this case, as the material of the cap member 22, silicone rubber, fluoride rubber, elastomeric material, or fluoride-family or silicone-family water repellency agent fine powder can be contained in a base rubber material and formed.

Further, an appropriate one of the fluorine-containing polymers is selected and the cap member 22 formed of rubber material is dip coated in a similar manner (immersed and pulled up), then is dried in an atmosphere at a predetermined temperature, whereby water-repellent treatment can be applied.

In the described configuration, if the cleaning operation is executed by sealing the nozzle formation face of the recording head with the capping unit 9 and applying negative pressure, ink sucked and discharged by the negative pressure from the recording head is stored in the internal space of the capping unit 9 and in this state, the capped state of the nozzle formation face of the recording head is released.

The suction pump is again driven, whereby the ink stored in the capping unit 9 is discharged through the ink discharge port. At this time, water-repellent treatment is applied to the slopes 27*a* and 27*b* formed in the capping unit 9, so that ink less remaining because of discharging enters the valley line 28 placed in the gravity direction as the ink is made spherical by the surface tension.

The ink entering the valley line 28 is led toward the ink discharge port 24 by capillary action occurring on the valley line 28 and is discharged by the suction operation of the suction pump.

Consequently, ink drops scarcely remain in the capping unit and ink is discharged through the ink discharge port 24, whereby the problem of accumulating the humectant contained in the ink at a high density in the capping unit with the passage of time can be circumvented.

Therefore, the ink in the nozzle orifices of the recording head in the capped state does not receive the effect of the remaining humectant and the degree to an increase in viscosity of ink or hardening of ink can be decreased efficiently.

Figure 5:
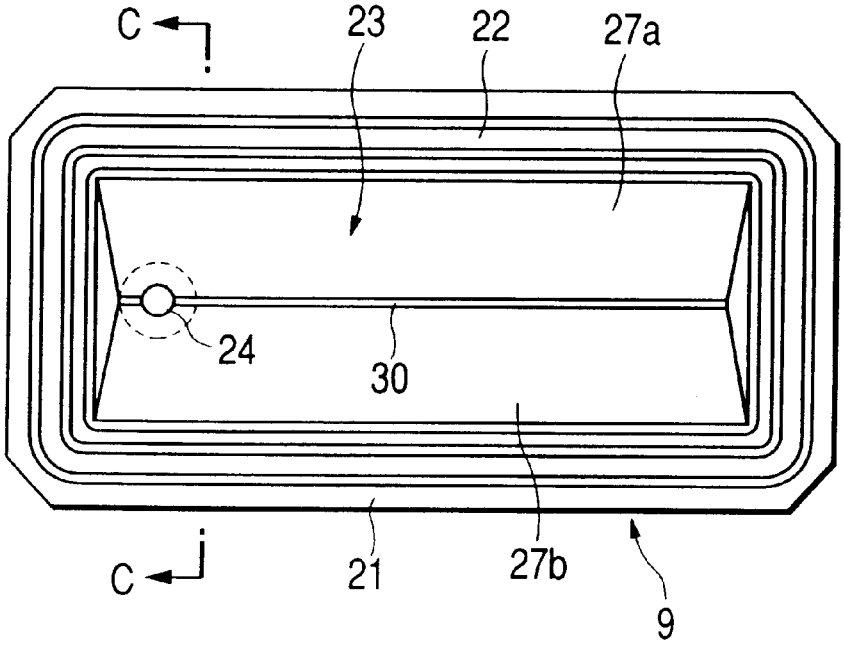
FIG. 5 is a plan view to show a capping unit placed according to a second embodiment of the invention.
Figure 6:
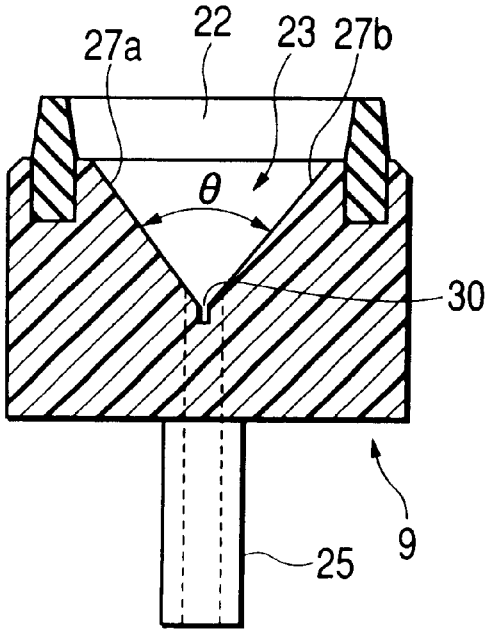
FIG. 6 is a sectional view taken on line C—C in arrow direction in FIG. 5.

Next, FIGS. 5 and 6 show a second embodiment of a capping unit placed in the recording apparatus.

FIG. 5 is a plan view of the capping unit from the top face thereof and FIG. 6 is a sectional view taken on line C—C in arrow direction in FIG. 5. Parts identical with or similar to those previously described with reference to FIGS. 3 and 4 are denoted by the same reference numerals in FIGS. 5 and 6.

The capping unit 9 in the second embodiment is similar to that in the first embodiment except that the valley line 28 shaped like V in cross section shown in FIG. 4 is hollowed to make a rectangular groove 30.

The groove 30 is made, whereby the capillary action on ink entering the groove 30 can be promoted and the effect of leading ink remaining in the capping unit toward the ink discharge port 24 can be enhanced effectively.

The groove 30 shown in FIGS. 5 and 6 is formed like a rectangle in cross section, but the cross-sectional form of the groove 30 is not limited thereto.

In the capping unit in the embodiment shown in FIG. 6, inner angle θ of the valley line 28 shaped like V in cross section by a pair of slopes 27*a* and 27*b* is made 160 degrees or less, preferably 120 degrees or less. That is, each slope 27*a* and 27*b* is formed having an inclination angle of 10 degrees or more, preferably 30 degrees or more with respect to the horizontal direction.

As shown in FIGS. 5 and 6, in the capping unit having an opening formed like a rectangle, preferably the slopes 27*a* and 27*b* are formed along the long side direction of the rectangle. In other words, the slopes 27*a* and 27*b* form the V shape in cross section in the short side direction as shown in FIG. 6.

According to the structure, while the inner angle θ of the valley line 28 shaped like V in cross section by the pair of slopes 27*a* and 27*b* is set to a predetermined angle, the dimension of a holder 21 in the height direction thereof can be decreased, contributing to miniaturization of the recording apparatus.

The range of the inner angle θ and the preferred placement direction of the slopes 27*a* and 27*b* in the capping unit formed like a rectangle are also applied to the capping unit of the first embodiment previously described with reference to FIGS. 3 and 4.

Figure 7:
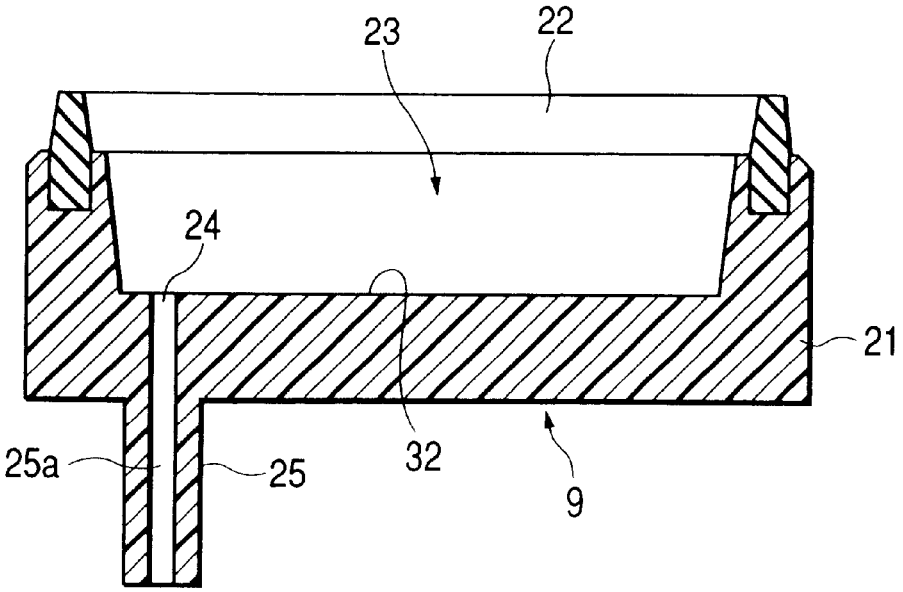
FIG. 7 is a longitudinal sectional view to show a capping unit according to a third embodiment of the invention.
Figure 8:
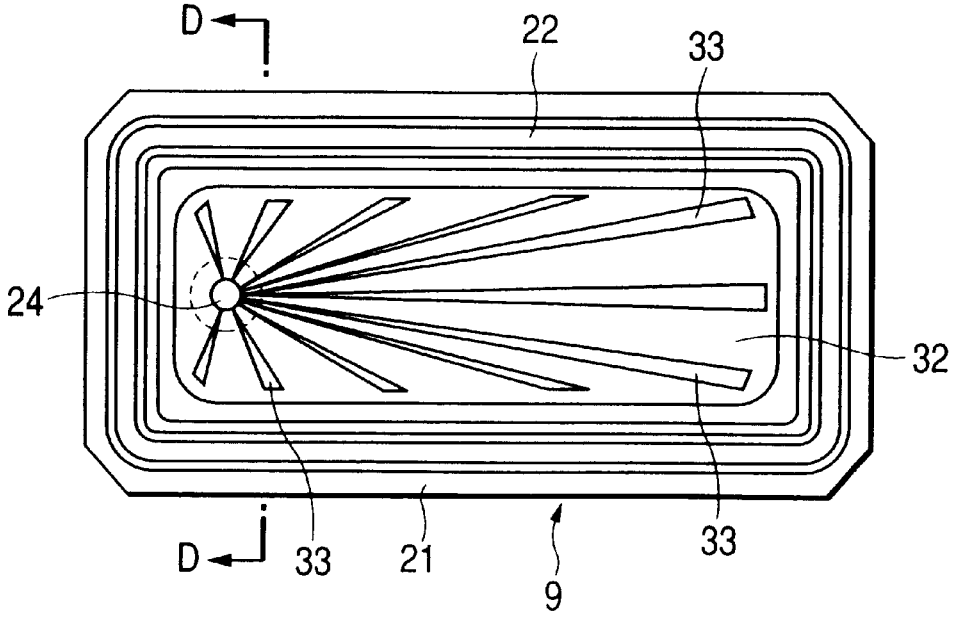
FIG. 8 is a plan view of the capping unit shown in FIG. 7.
Figure 9:
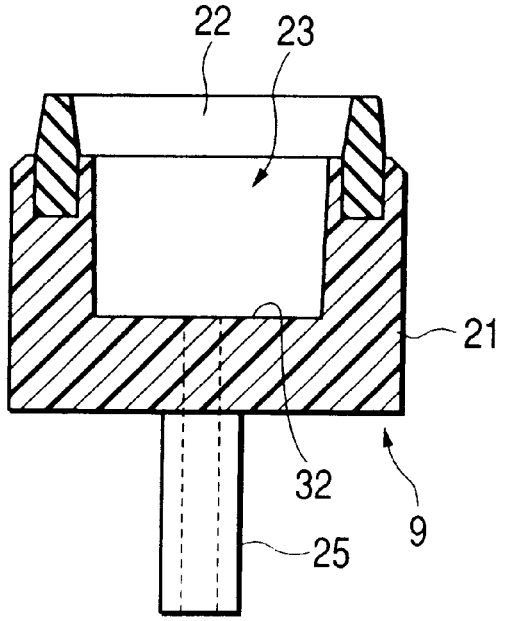
FIG. 9 is a sectional view taken on line D—D in arrow direction in FIG. 8.

Next, FIGS. 7 to 9 show a third embodiment of a capping unit placed in the recording apparatus.

FIG. 7 is a longitudinal sectional view of the capping unit, FIG. 8 is a plan view of the capping unit from the top face thereof, and FIG. 9 is a sectional view taken on line D—D in arrow direction in FIG. 8. Parts identical with or similar to those previously described with reference to FIGS. 3 and 4 are denoted by the same reference numerals in FIGS. 7 to 9.

In the third embodiment, as seen in FIGS. 7 and 9, an inner bottom 32 of the capping unit 9 is planarly formed and a plurality of grooves 33 as an ink leader are placed in the planar inner bottom 32 so as to form a radial pattern toward an ink discharge port 24 as shown in FIG. 8.

The width of each groove 33 is narrowed gradually toward the ink discharge port 24.

According to the structure, ink attempting to remain on the inner bottom 32 of the capping unit 9 enters any of the grooves 32 and is led to the ink discharge port 24 along the groove 33.

Since the width of each groove 33 is narrowed gradually toward the ink discharge port 24 as described above, the capillary action on the ink entering the groove 33 can be promoted and the effect of leading ink remaining in the capping unit toward the ink discharge port 24 can be enhanced effectively.

In the third embodiment, a plurality of grooves 33 are made toward the ink discharge port 24, but a plurality of projection ribs 33 may be formed toward the ink discharge port 24 in place of the grooves.

According to the structure, capillary action occurs in a gap formed by the adjacent projection ribs 33 and ink is led to the ink discharge port 24 along the gap.

Likewise, the spacing between the gaps formed by the projection ribs 33 is narrowed gradually toward the ink discharge port 24, whereby the capillary action on the ink entering the gap between the projection ribs 33 can be promoted and the effect of leading ink remaining in the capping unit toward the ink discharge port 24 can be enhanced effectively.

Figure 10:
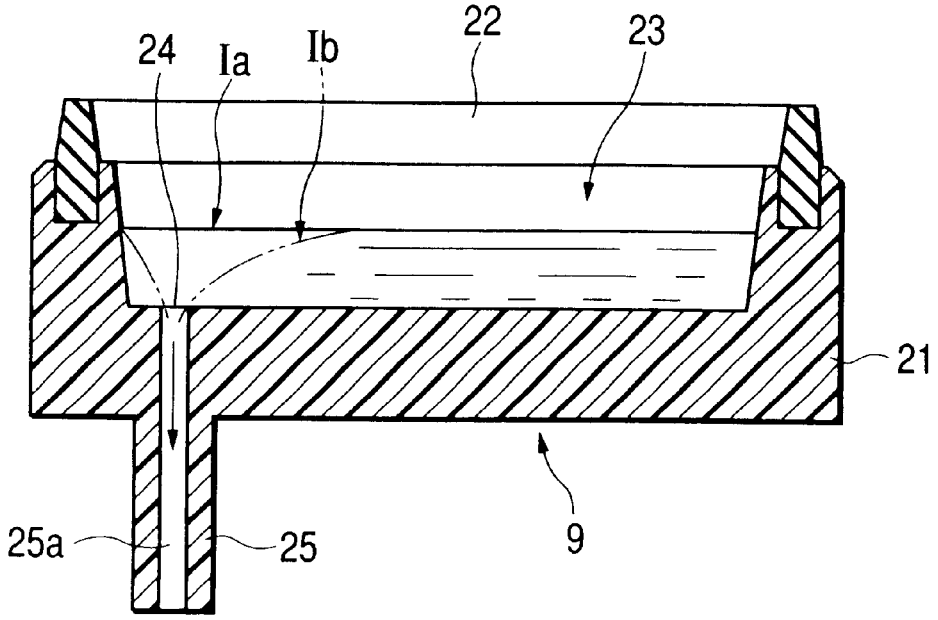
FIG. 10 is a sectional view to schematically show a preferred method of discharging ink from the capping unit according to the first to third embodiments.

FIG. 10 shows a preferred form of an ink discharge method from the capping unit, executed after negative pressure is applied for sucking and discharging ink from the recording head when the described a capping unit is used. Parts identical with or similar to those previously described with reference to the figures are denoted by the same reference numerals in FIG. 10.

FIG. 10 shows a state in which the capped state of the nozzle formation face of the recording head is released in a state in which ink discharged from the recording head is stored in the internal space of the capping unit and subsequently the ink is sucked from the ink discharge port made in the capping unit to the suction pump side by driving the suction pump.

In this case, it turns out that if the ink is sucked at comparatively high speed by the suction pump, a suction vortex lb is formed on the ink surface above the ink discharge port 24.

That is, since the ink suction speed is fast, the liquid level of the ink is broken like a funnel and some air is sucked from the ink discharge port 24, as shown in FIG. 10.

If the ink is discharged in the form, a phenomenon is found out in which when the remaining amount of ink in the capping unit becomes small, the ink flow in the direction of the ink discharge port 24 is cut off and ink drops are left like several islands.

On the other hand, it turn ed out that if the suction pump is driven at low suction speed to such an extent that the suction vortex lb is not formed on the ink surface, liquid level 1*a* of the ink stored in the capping unit 9 lowers uniformly and when the remaining amount of ink in the capping unit becomes small, the remaining ink is also led toward the ink discharge port 24 as it is dragged by the ink flow toward the ink discharge port 24.

Consequently, it turned out that the phenomenon in which ink drops are left like several islands in the capping unit does not occur and that the ink is discharged so that the remaining amount becomes zero or so. Therefore, the described a capping unit is adopted and further the described ink discharge method is also adopted together, whereby the remaining amount of ink in the capping unit can be decreased extremely.

In the capping unit used in the recording apparatus according to the above embodiments, a comparatively large bubble shaped like a so-called soup bubble appears in the capping unit by the surface tension of an ink solvent because an ink absorption material is removed.

The recording apparatus according to the fourth embodiment of the invention is intended for avoiding occurrence of a print failure caused by the bubble, whereby an ink jet recording apparatus that can ensure reliability of print of a recording head can be provided like the recording apparatus in the first aspect of the invention.

Figure 11:
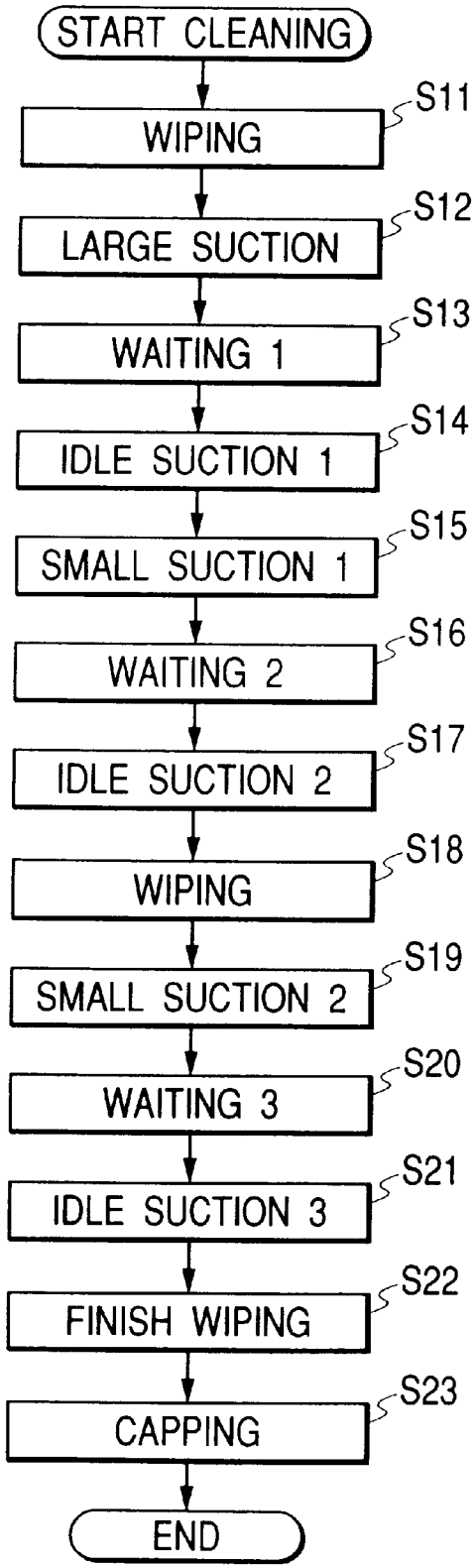
FIG. 11 is a flowchart to show preferred cleaning operation executed in a recording apparatus according to a fourth embodiment of the invention.

FIG. 11 shows a controller that can avoid a print failure of a print head even if a comparatively large bubble shaped like a soup bubble appears, and shows a recording head cleaning sequence executed by the controller.

That is, upon reception of a cleaning command, the controller executes the wiping operation of moving carriage 1 shown in FIG. 1 and wiping out the nozzle formation face of a recording head 12 mounted on the carriage 1 by a wiping member 11 at step S11.

The wiping operation at step S11 is performed to enhance adhesion of the nozzle formation face to a cap member in processing of forcibly sucking and discharging ink from the recording head by a capping unit 9 following the wiping operation.

Subsequently, at step S12, the recording head 12 is moved to the top of the capping unit 9 and the nozzle formation face of the recording head 12 is sealed with the capping unit 9 accordingly. A suction pump 10 is driven for a predetermined time, whereby the operation of substantial suction of sucking and discharging a comparatively large amount of ink from the recording head 12 is executed.

Next, at step S13, a wait is made for a predetermined time and meanwhile ink is discharged into the capping unit 9 and the negative pressure in the capping unit 9 approaches atmospheric pressure accordingly.

Figure 36:
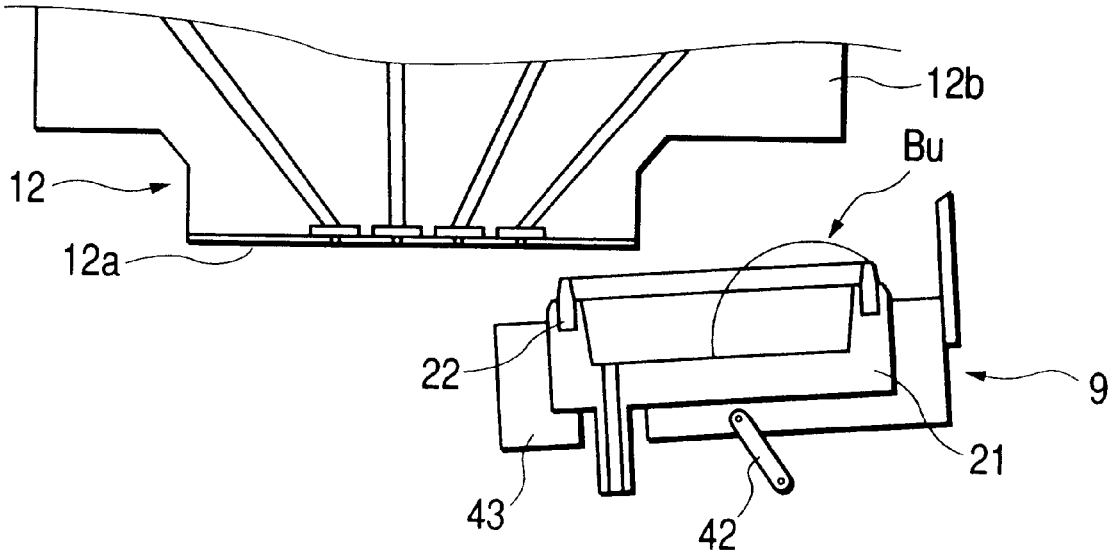
FIG. 36 is a longitudinal sectional view to show a state in which further the recording head is moved to the side of a print area from the state shown in FIG. 35.

At step S14, the carriage 1 is moved to the print area and the capping unit 9 is moved down accordingly, whereby the seal state of the nozzle formation face of the recording head 12 is released. At this time, a large bubble Bu shaped like a soup bubble appears in the capping unit 9 as shown in FIG. 36.

The suction pump 10 is again driven, whereby idle suction is executed for discharging the ink discharged into the capping unit 9. At this time, if an ink discharge port 24 is positioned in the bubble Bu, the bubble Bu is not shrunk and is left.

The carriage 1 is again moved to the home position and the recording head 12 is sealed with the capping unit 9. At this time, the following problem occurs: The bubble Bu generated in the capping unit 9 disappears and an ink meniscus formed in a nozzle orifice is destroyed.

However, at step S15, the operation of sucking a small amount of ink from the recording head 12 is executed, whereby the destroyed meniscus is restored to the former state.

At step S16, a wait is made for a predetermined time and meanwhile ink is discharged into the capping unit 9 and the negative pressure in the capping unit 9 is canceled.

At step S17, the idle suction operation is again executed; at this time, the remaining amount of ink in the capping unit 9 is extremely small and therefore the degree of occurrence of another large bubble Bu is extremely low.

At step S18, the recording head 12 passes through the top of the wiping member 11 and undergoes the wiping operation of the wiping member 11 and ink deposited on the nozzle formation face is removed by the wiping operation.

Subsequently, at step S19, a small amount of ink is again sucked from the recording head 12 by the capping unit 9.

Likewise, at steps S20 and S21, the wait operation and the idle suction operation are executed and at step S22, the recording head 12 passes through the top of the wiping member 11 and undergoes the finish wiping operation. At step S23, the recording head 12 is sealed with the capping unit 9 and the cleaning sequence is now complete.

As seen from the control sequence described with reference to FIG. 11, a large bubble appearing after a large amount of ink is sucked is destroyed by the capping unit 9 and a meniscus destroyed as the bubble is destroyed can be restored to the former state by executing the following operation of sucking a small amount of ink, so that occurrence of a print failure of the recording head can be avoided effectively.

Figure 12:
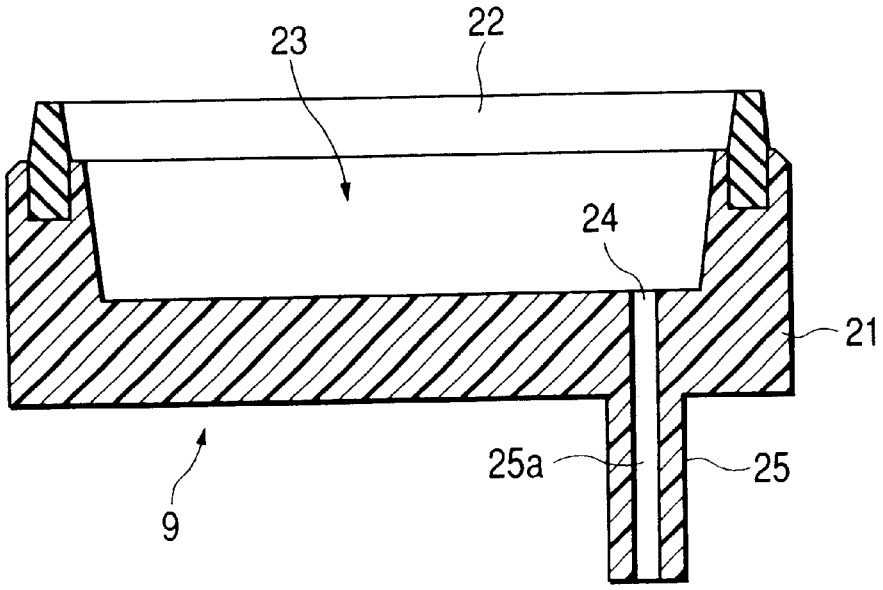
FIG. 12 is a longitudinal sectional view to show a capping unit according to the fourth embodiment of the invention.
Figure 13:
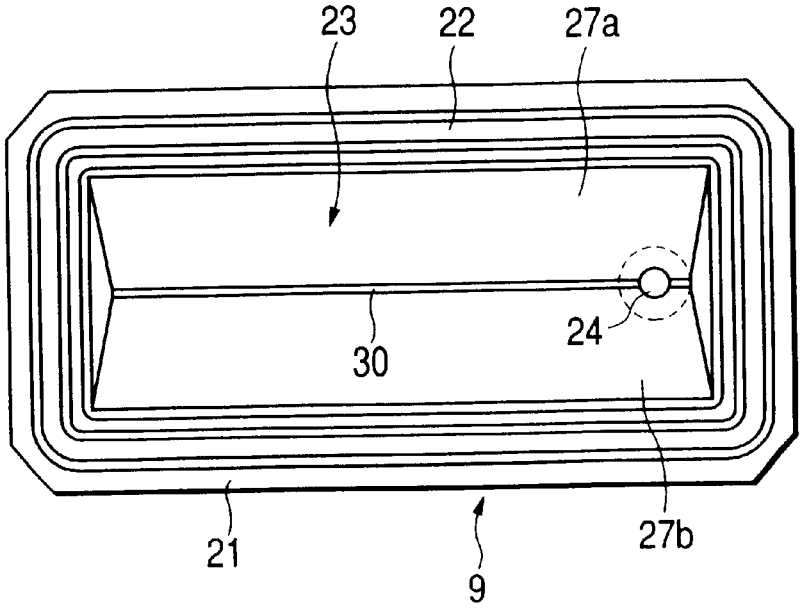
FIG. 13 is a plan view of the capping unit shown in FIG. 12.

Next, FIGS. 12 and 13 show a capping unit according to the embodiment wherein if a comparatively large bubble shaped like a soup bubble appears, it is sucked, whereby the bubble can be shrunk or extinguished for avoiding a print failure. FIG. 12 is a longitudinal sectional view of the capping unit and FIG. 13 is a plan view of the capping unit. Parts identical with or similar to those previously described with reference to the figures are denoted by the same reference numerals in FIGS. 12 and 13.

As previously described with reference to FIGS. 33 to 36, the capping unit 9 shown in FIGS. 12 and 13 is used for a recording apparatus wherein a capping unit is brought out of contact with the nozzle formation face in an unparallel state therewith, whereby the following unique advantages can be provided:

In the structure of the capping unit 9 shown in FIGS. 12 and 13 as compared with the structure previously described with reference to FIGS. 5 to 7, an ink discharge port 24 is formed in an opposite position in the move direction of recording head, namely, formed on the home position side.

This capping unit 9 is adopted in the structure previously described with reference to FIGS. 33 to 36, whereby the ink discharge port 24 is placed at a position corresponding to an end part where the spacing between the nozzle formation face and the capping unit 9 is narrower when sealing of the nozzle formation face is released.

Therefore, the ink discharge port 24 is placed just below a large bubble Bu left in the capping unit 9 as shown in FIG. 36, and the bubble Bu can be reliably extinguished or shrunk by driving a suction pump.

Thus, the degree of occurrence of a print failure caused by the large bubble Bu appearing in the capping unit 9 can be decreased drastically.

Figure 14:
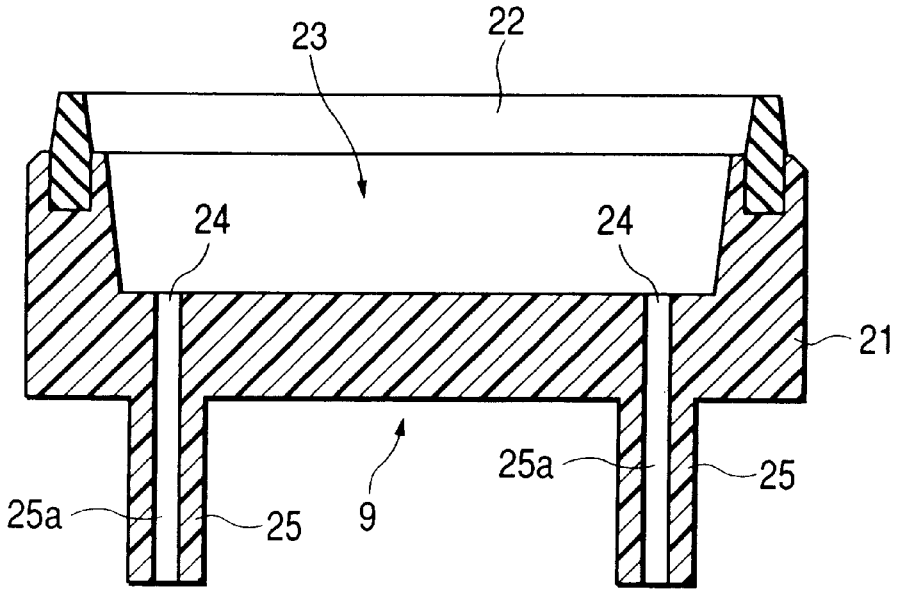
FIG. 14 is a longitudinal sectional view to show a capping unit according to a fifth embodiment of the invention.
Figure 15:
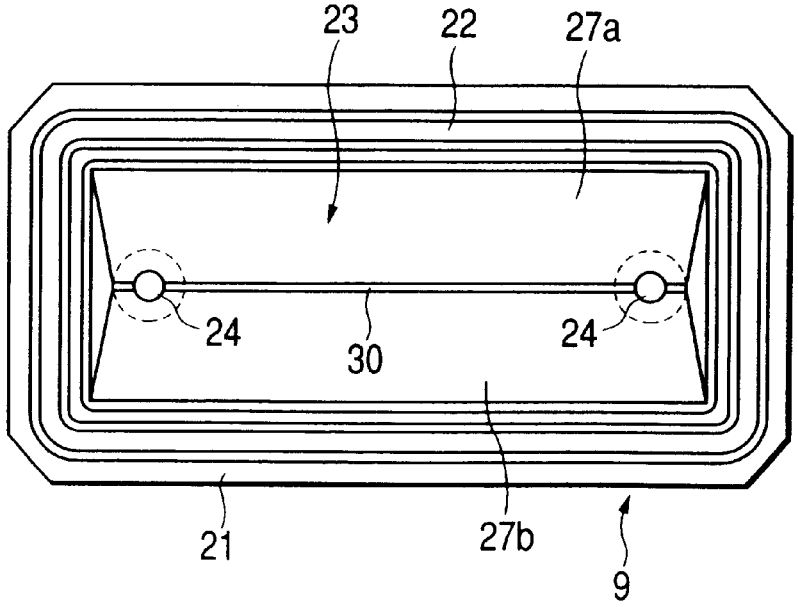
FIG. 15 is a plan view of the capping unit shown in FIG. 14.

Next, FIGS. 14 and 15 show a capping unit according to a fifth embodiment of the invention. FIG. 14 is a longitudinal sectional view of the capping unit and FIG. 15 is a plan view of the capping unit. Parts identical with or similar to those previously described with reference to the figures are denoted by the same reference numerals in FIGS. 14 and 15.

As previously described with reference to FIG. 2, the capping unit 9 shown in FIGS. 14 and 15 is used for a structure wherein a capping unit is brought out of contact with the nozzle formation face in an almost parallel state therewith, whereby the following unique advantages can be provided.

In the structure of the capping unit 9 shown in FIGS. 14 and 15, an ink discharge port 24 is placed at both end parts of the capping unit 9 corresponding to the move direction of recording head.

According to the structure previously described with reference to FIG. 2, the capping unit 9 is brought into or out of contact with the nozzle formation face of the recording head while it holds the almost horizontal attitude, thus the position of a bubble appearing when the capping unit 9 is brought out of contact with the nozzle formation face is not fixed to a specific position. The bubble may be dragged in the move direction of the recording head, namely, to the print area side and be generated at the position.

To deal with the action, as shown in FIGS. 14 and 15, each ink discharge port 24 is placed at both end parts of the capping unit 9 corresponding to the move direction of the recording head and these two ink discharge ports 24 are sucked by a suction pump, whereby the bubble Bu can be extinguished or shrunk reliably.

Thus, the degree of occurrence of a print failure caused by the large bubble Bu generated in the capping unit 9 can be decreased drastically.

Figure 16:
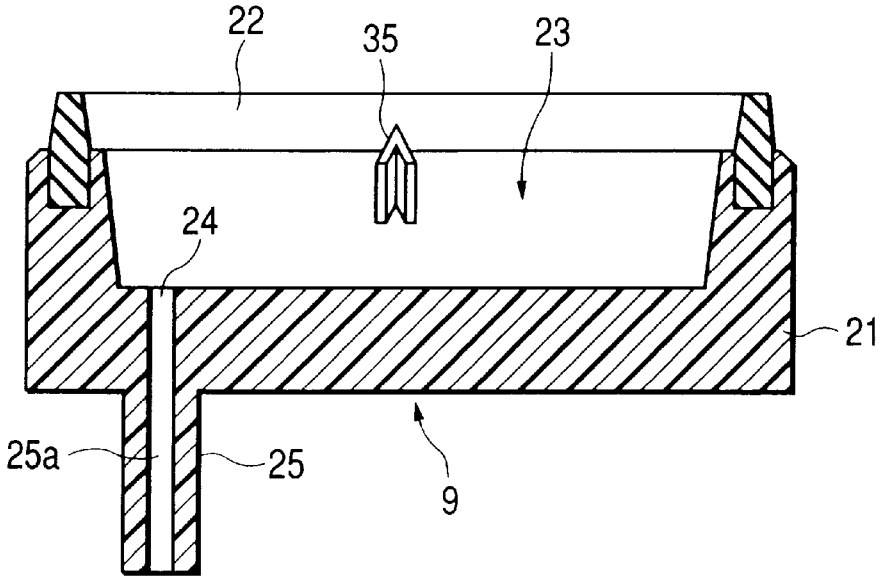
FIG. 16 is a longitudinal sectional view to show a capping unit according to a sixth embodiment of the invention.
Figure 17:
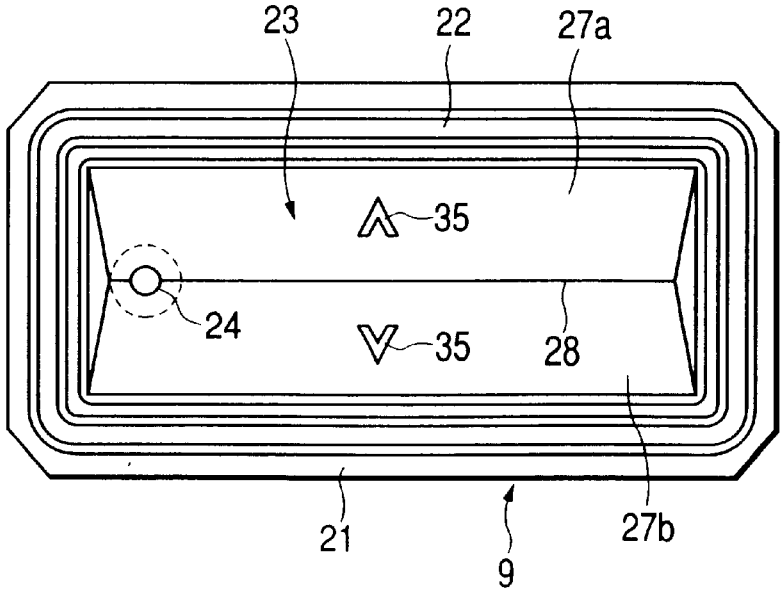
FIG. 17 is a plan view of the capping unit shown in FIG. 16.

Next, FIGS. 16 and 17 show a capping unit according to a sixth embodiment of in the invention.

FIG. 16 is a longitudinal sectional view of the capping unit and FIG. 17 is a plan view of the capping unit. Parts identical with or similar to those previously described with reference to the figures are denoted by the same reference numerals in FIGS. 16 and 17.

As compared with the capping unit 9 previously described with reference to FIGS. 3 and 4, the capping unit 9 shown in FIGS. 16 and 17 comprises a projection 35 formed perpendicularly almost at the centers of the respective slopes 27*a* and 27*b*.

According to the structure, the degree of extinguishing a comparatively large bubble left in the capping unit 9 can be raised in the presence of the two projection parts 35. Thus, the degree of occurrence of a print failure caused by the large bubble Bu generated in the capping unit 9 can be decreased.

It is also effective to adopt the projection part 35 for the embodiment previously described with reference to FIGS. 12 and 13 or FIGS. 14 and 15; in doing so, the degree of occurrence of a print failure caused by a bubble can be decreased synergistically.

The structures according to the fourth to sixth embodiments of the invention are intended for providing countermeasures against generation of a comparatively large bubble like a soup bubble; it is also effective to consider an ink composition for making it possible to lower the bubble generation degree or naturally extinguish a bubble earlier.

As a result of considering from such a viewpoint, an ink composition presenting a small bubble generation effect or a bubble extinguishing effect by containing 0.2%–1.5% by weight of a surfactant in an ink composition using a pigment was found out.

As the surfactant used with the ink composition, for example, Olefin STG (manufactured by Shin-Etsu Chemical Co., Ltd.) can be used preferably.

Table 1 lists the preferred ink compositions. In the table, B, Y, M, and C denote black ink, yellow ink, magenta ink, and cyan ink respectively, and TEG-mBE denotes triethylene glycol monobutyl ether.

TABLE 1

| | B | Y | M | C |
|---|---|---|---|---|
| C.I. Direct Black 154 | 4 | | | |
| C.I. Direct Yellow 132 | | 1.2 | | |
| C.I. Direct Yellow 86 | | 0.8 | | |
| C.I. Acid Red 289 | | | 0.4 | |
| C.I. Acid Red 52 | | | 1.0 | |
| C.I. Acid Blue 9 | | | | 2 |
| TEG-mBE | 10 | 10 | 10 | 10 |
| Surphynol 465 | 0.8 | 0.8 | 0.8 | 0.8 |
| Diethylene Glycol | 7 | 15 | 17 | 17 |
| Proxel XL-2 | 0.3 | 0.3 | 0.3 | 0.3 |
| Olefin STG | 1 | 1 | 1 | 1 |
| Water | 76.9 | 70.9 | 69.5 | 68.9 |

Surfynol 465 (manufactured by Air Product and Chemicals, Inc. and distributed by Shin-Etsu Chemical Co., Ltd.) is used and Proxel XL-2 (manufactured by ZENECA Limited) is used. The numeric values of the ink compositions are shown in wt %.

As a result of an experiment, the fact was found out that if the content of Olefin STG as the surfactant is less than 0.2 wt %, the effect of decreasing the bubble generation effect or increasing the bubble extinguishing effect cannot be expected in practical use.

If the content of Olefin STG exceeds 1.5 wt %, the image quality characteristic essentially required as ink was impaired. Specifically, osmosis was raised largely and thus oozing occurred on paper or mixing of adjacent inks (bleed) became conspicuous.

As described above, ink containing 0.2%–1.5% by weight of a surfactant in the ink composition is used in the recording apparatus according to the fourth to sixth embodiments of the invention, whereby the degree of occurrence of a large bubble like a soup bubble can be decreased and occurrence of a print failure can be avoided more effectively with the synergistic effect with the structure of the recording apparatus according to the fourth to sixth embodiments.

As described above, in the ink jet recording apparatus according to the first to third embodiments of the invention, the ink discharge port communicating with the negative pressure generator is formed at the bottom of the internal space of the capping unit and the ink leader for producing the capillary action on ink discharged from the recording head and leading ink in the internal space to the ink discharge port is formed, so that the ink in the capping unit can be led to the ink discharge port by the capillary action and can be discharged instantly by the negative pressure generator.

In addition, when ink is discharged from the capping unit, the negative pressure generator is driven at low suction speed to such an extent that a suction vortex is not formed on the ink surface above the ink discharge port, whereby the remaining amount of ink in the capping unit can be decreased drastically, and the problem of accumulating the humectant contained in the ink solvent in the internal space of the capping unit can be circumvented even in long-term use.

According to the ink jet recording apparatus according to the second aspect of the invention, the cleaning a controller for executing small suction operation following large suction operation can be used to effectively recover from a print failure caused by an ink bubble appearing in the capping unit.

The placement position of the ink discharge port made in the capping unit is devised, whereby it is made possible to efficiently remove or shrink the above-mentioned bubble.

In addition, the ink composition with a predetermined amount of surfactant added is used in the described recording apparatus, whereby occurrence of a print failure caused by an ink bubble can be avoided synergistically.

Figure 18:
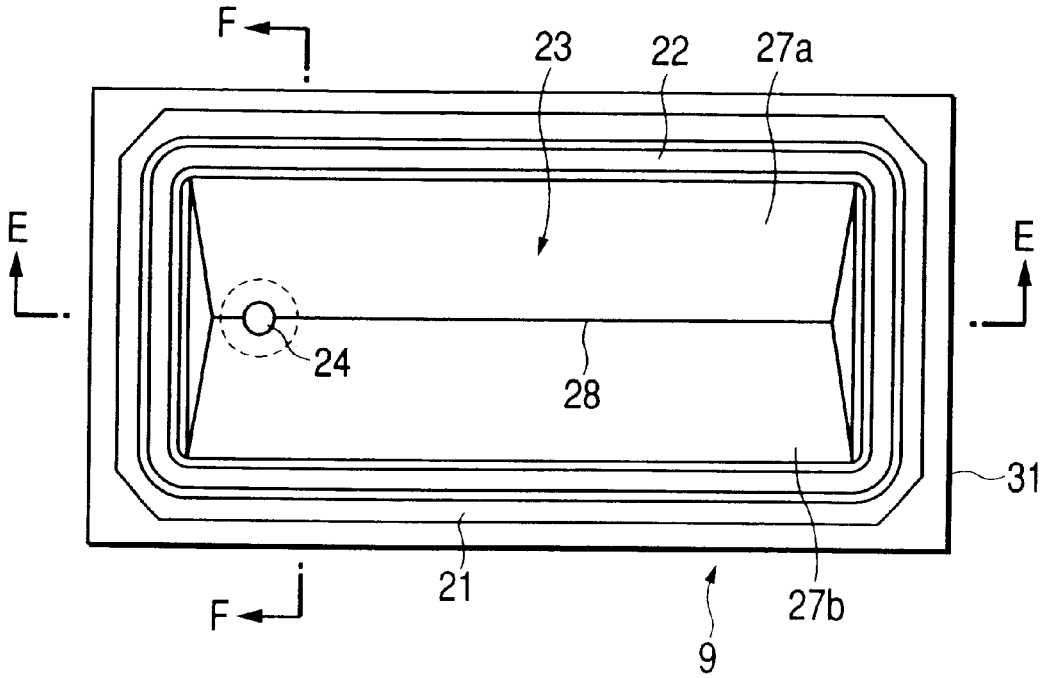
FIG. 18 is a plan view to show a capping unit according to a seventh embodiment of the invention.
Figure 19:
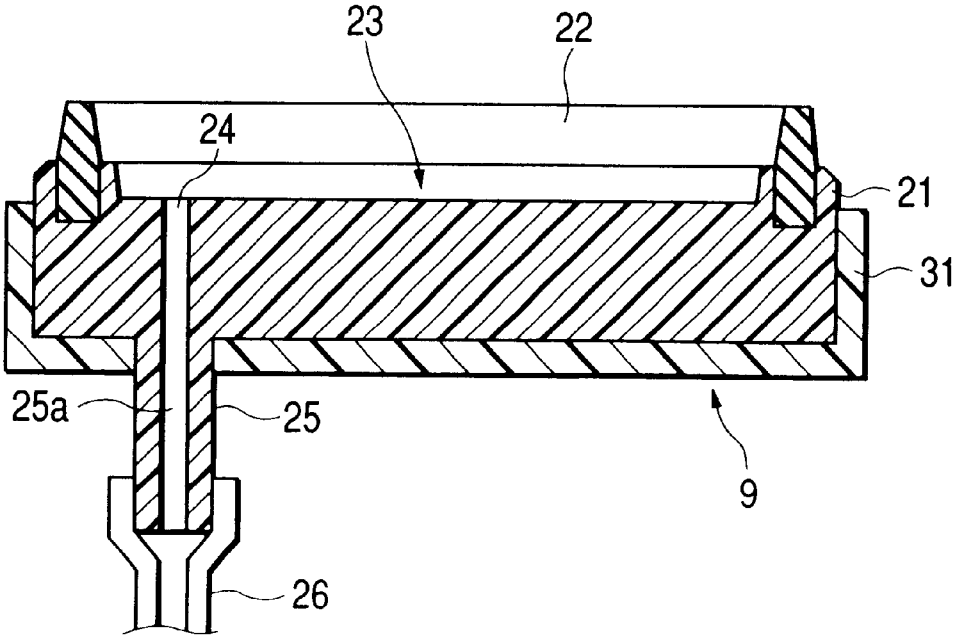
FIG. 19 is a sectional view taken on line E—E in arrow direction shown in FIG. 18.
Figure 20:
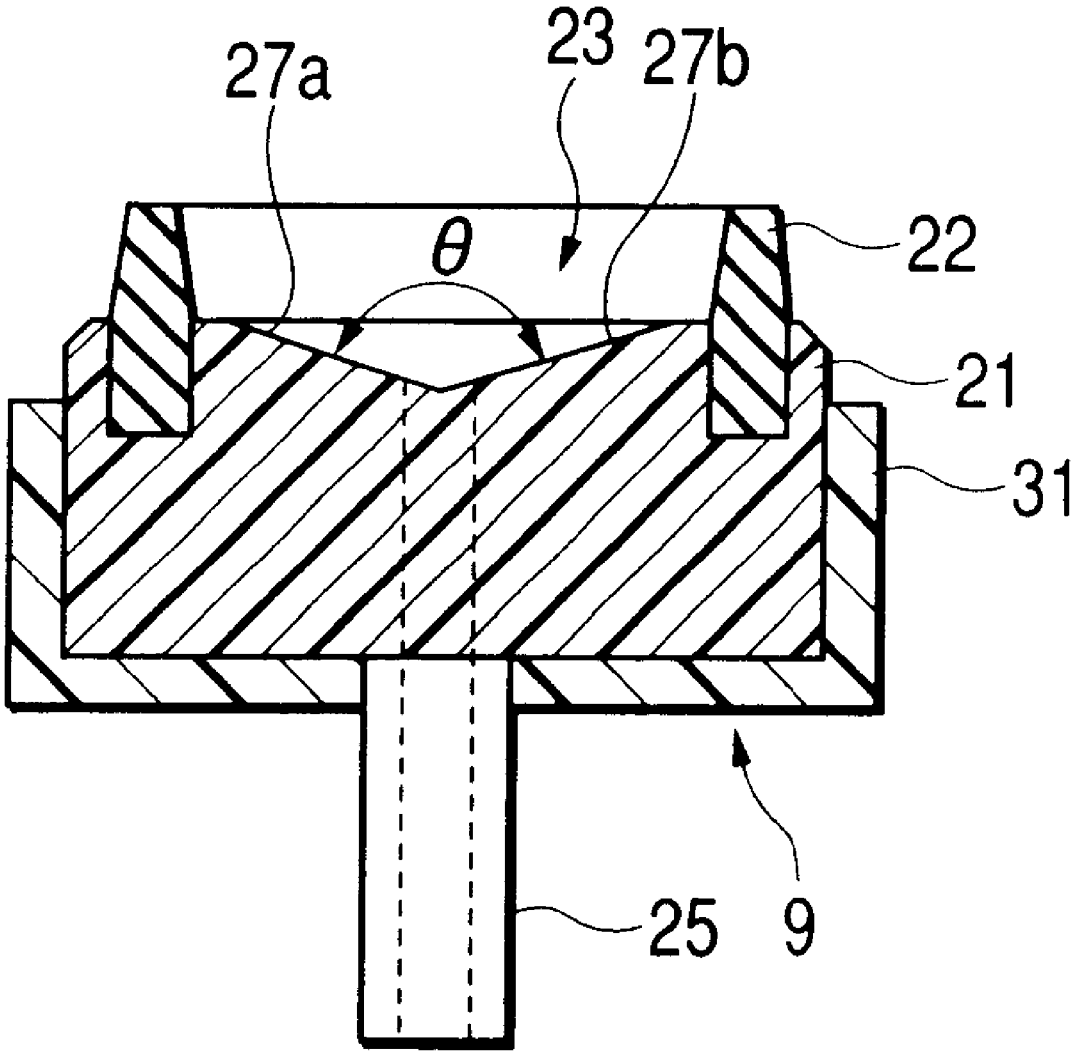
FIG. 20 is a sectional view taken on line F—F in arrow direction shown in FIG. 18.

FIGS. 18 to 20 show an ink jet recording apparatus according to a seventh embodiment of the invention.

FIG. 18 is a plan view of a capping unit from the top face thereof, FIG. 19 is a sectional view taken on line E—E in arrow direction in FIG. 18, and FIG. 20 is a sectional view taken on line F—F in arrow direction in FIG. 18.

The capping unit 9 is made up of a holder 21 formed almost like a rectangular parallelepiped and a cap member 22 of a rubber material (for example, elastomer), having an end face formed almost like a square, the cap member 22 being placed on the top face of the holder 21.

The cap member 22 is attached to the holder 21 in a state in which it is buried along the margins of the top face of the holder 21 as shown in FIG. 19. The cap member 22 is identical with the cap member 9*d* previously described with reference to FIG. 2. The cap member 22 forms an opening for sealing the nozzle formation face 12 of the recording head 12.

The holder 21 is molded of a synthetic resin, for example, and is formed with an internal space 23 and at a bottom with an ink discharge port 24.

On the bottom face of the holder 21 formed with the ink discharge port 24, a suction pipe 25 is molded integrally with the holder 21 and the ink discharge port 24 is made to communicate with a pipe line 25*a* formed in the suction pipe 25.

A tube 26 is connected to a lower end part of the suction pipe 25 and is connected to the suction pump 10 provided as a negative pressure generator, as shown in FIG. 19. An outer shell member 31 molded separately from the holder 21 is attached to the peripheral walls and bottom wall of the holder 21, forming the capping unit 9.

As shown in FIG. 18, the capping unit 9 is formed with an opening like a rectangle and a pair of slopes 27*a* and 27*b* inclined from the opening to the bottom along the long side direction of the rectangle. A part of a valley line 28 which is shaped like V in cross section, formed by the pair of slopes 27*a* and 27*b* which cross each other contacts the ink discharge port 24.

The valley line 28 formed by the pair of slopes 27*a* and 27*b* provides an ink leader for giving capillary action to ink remaining along the valley line 28, whereby the ink remaining along the valley line 28 is led toward the ink discharge port 24.

On the other hand, in the embodiment, preferably, as shown in FIG. 20, inner angle θ formed by the pair of slopes 27*a* and 27*b* is made 160 degrees or less as large as possible. In other words, preferably each slope 27*a* and 27*b* is formed having an inclination angle of 10 degrees or more with respect to the horizontal direction and is made close to a horizontal state as much as possible.

Considering water-repellent treatment as described later, surface roughness, etc., even at the above-mentioned inclination angle, ink can be made to smoothly flow toward the valley line 28 and a problem of some of ink remaining on the slope can also be solved.

Moreover, in the capping unit having an opening formed like a rectangle as in the embodiment, preferably the slopes 27*a* and 27*b* are formed along the long side direction of the rectangle.

The structure is adopted and the inner angle θ formed by the pair of slopes 27*a* and 27*b* is set as large as possible within the above-mentioned angle range, whereby the dimension of the holder 21 in the height direction thereof can be decreased, contributing to miniaturization of the recording apparatus.

According to the structure, the dimension from the opening of the capping unit 9 to the bottom of the internal space 23 is also lessened, so that the degree of separating ink into minute drops and changing to fog (ink mist) in the flushing operation of idly jetting ink toward the capping unit 9 can be decreased and the effect of making it possible to decrease occurrence of contamination caused by occurrence of the ink mist can also be expected.

Preferably, water-repellent treatment is applied to the inner bottom of the capping unit 9, particularly, the pair of slopes 27*a* and 27*b*.

By applying water-repellent treatment to the slopes 27*a* and 27*b*, if ink is discharged by the capping unit 9 as described later, it does not stick to the slope 27*a*, 27*b* to which water-repellent treatment is applied, and smoothly moves to the valley line 28 forming the ink leader as the ink is made spherical by the surface tension.

As means for applying the water-repellent treatment, the means covered in the description of the recording apparatus according to the first to third embodiments can be used intact. It is also effective to apply water-repellent treatment to the cap member 22 as in the first to third embodiments.

In the recording apparatus according to this embodiment, preferably mirror finish is applied to the pair of slopes 27*a* and 27*b* to which such water-repellent treatment is applied so that the surface roughness of the slope 27*a*, 27*b* becomes within 25 μm. Such surface treatment can be accomplished by applying mirror finish to the metal mold for molding the holder 21.

In the described structure, if the cleaning operation is executed by sealing the nozzle formation face of the recording head 12 with the capping unit 9 and applying negative pressure, ink sucked and discharged from the recording head 12 by the negative pressure is stored in the internal space 23 of the capping unit 9 and in this state, the capped state of the nozzle formation face of the recording head 12 is released.

The suction pump 10 as negative pressure means is again driven, whereby the ink stored in the capping unit 9 is discharged through the ink discharge port 24.

At this time, mirror finish and water-repellent treatment are applied to the slopes 27*a* and 27*b* formed in the capping unit 9 as described above, so that ink less remaining because of discharging enters the valley line 28 placed in the gravity direction as the ink is made spherical by the surface tension.

The ink entering the valley line 28 is led toward the ink discharge port 24 by capillary action occurring on the valley line 28 and is discharged by the suction operation of the suction pump 10.

Consequently, ink drops scarcely remain in the capping unit 9 and ink is discharged through the ink discharge port 24, whereby the problem of accumulating the humectant contained in the ink at a high density in the capping unit with the passage of time can be circumvented.

Therefore, the ink in the nozzle orifices of the recording head in the capped state does not receive the effect of the remaining humectant and the degree to an increase in viscosity of ink or hardening of ink can be decreased efficiently.

In the embodiment, the holder 21 forming the inner bottom face of the capping unit 9 is molded of a synthetic resin and the seal member 22 capable of sealing the recording head is molded of a rubber material as described above and therefore they differ in interfacial state because of the structure, so that occurrence of bubbles caused by the surface tension of ink can be decreased.

Therefore, the degree of occurrence of a print failure such as missing dots caused by occurrence of a bubble can be decreased. Water-repellent treatment is applied to the inner face of the capping unit 9 as described above and further the surface roughness of the inner bottom face of the capping unit 9 is placed with the above-mentioned numeric value, whereby the bubble occurrence degree can also be decreased synergistically.

Figure 21:
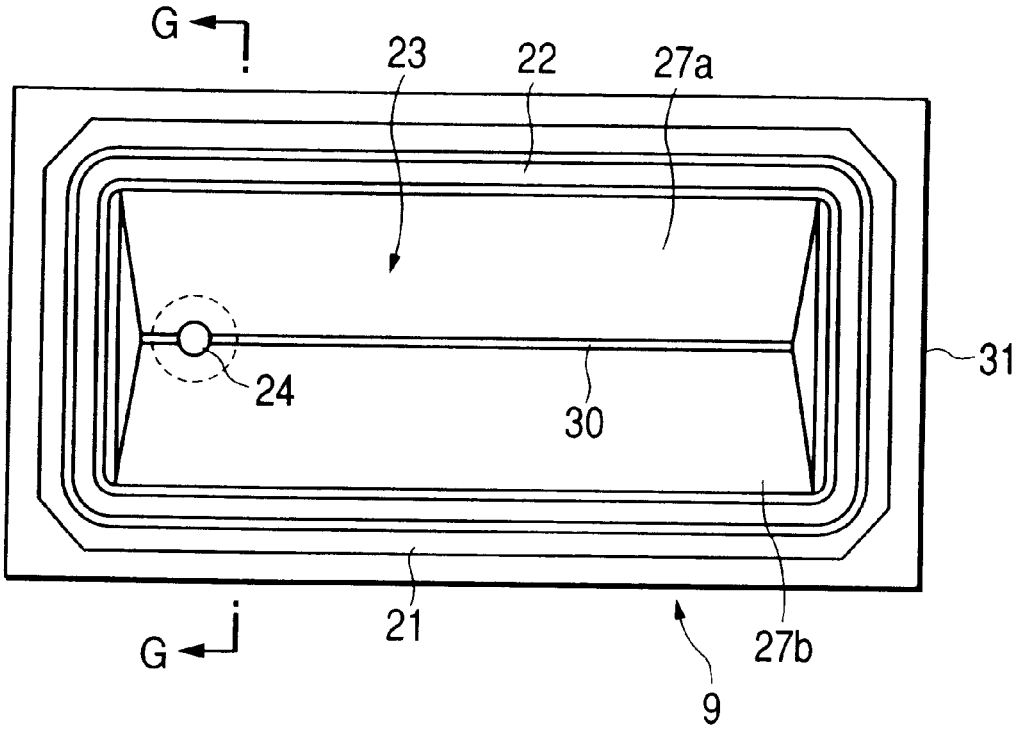
FIG. 21 is a plan view to show a capping unit according to an eighth embodiment of the invention.
Figure 22:
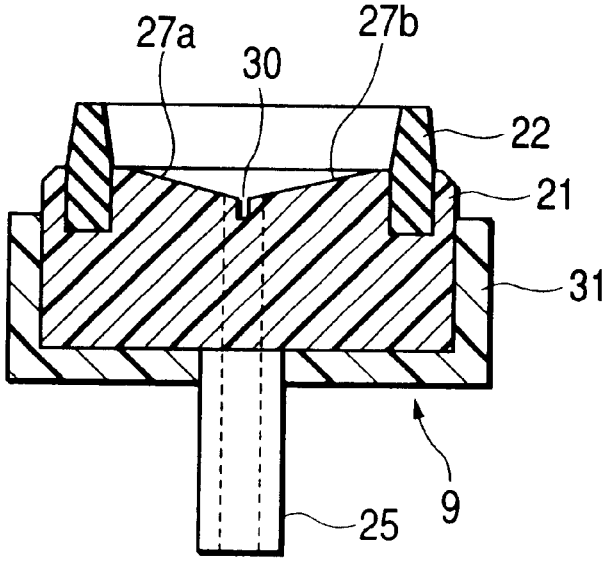
FIG. 22 is a sectional view taken on line G—G in arrow direction shown in FIG. 21.

Next, FIGS. 21 and 22 show a capping unit according to an eighth embodiment of the invention.

FIG. 21 is a plan view of the capping unit from the top face thereof and FIG. 22 is a sectional view taken on line G—G in arrow direction in FIG. 21. Parts identical with or similar to those previously described with reference to FIGS. 18 to 20 are denoted by the same reference numerals in FIGS. 21 and 22. The capping unit 9 in the embodiment is similar to that in the seventh embodiment except that the valley line 28 shown in FIG. 20 is hollowed to make a rectangular groove 30.

The groove 30 is made, whereby the capillary action on ink entering the groove 30 can be promoted and the effect of leading ink remaining in the capping unit 9 toward the ink discharge port 24 can be enhanced effectively.

The groove 30 shown in FIGS. 21 and 22 is formed like a rectangle in cross section, but the cross-sectional form of the groove 30 is not limited thereto.

Also in the structure shown in FIGS. 21 and 22, preferably mirror finish and water-repellent treatment are applied to at least a pair of slopes 27*a* and 27*b* as in the first embodiment previously described with reference to FIGS. 18 to 20.

Figure 23:
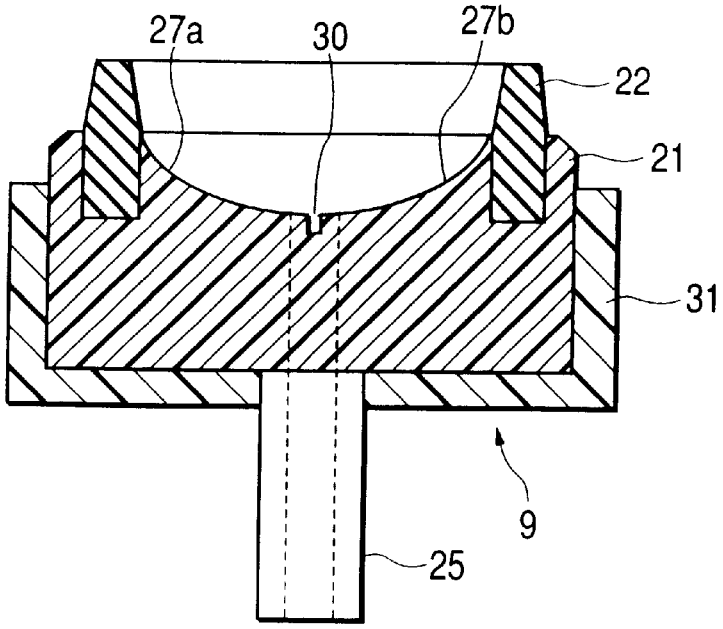
FIG. 23 is a longitudinal sectional view to show a capping unit according to a ninth embodiment of the invention.
Figure 24:
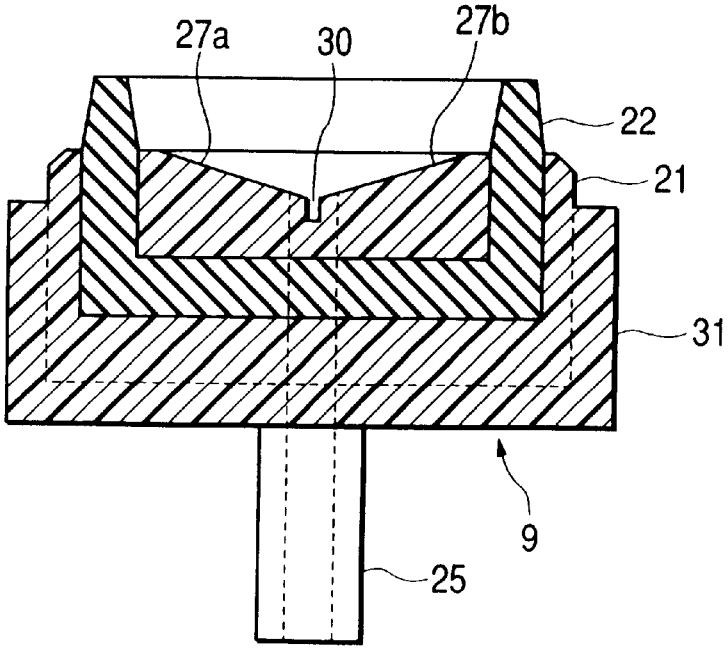
FIG. 24 is a longitudinal sectional view to show a capping unit according to a tenth embodiment of the invention.

Next, FIGS. 23 and 24 respectively show a capping unit according to a ninth embodiment and a tenth embodiment of the invention.

FIGS. 23 and 24 are sectional views of the capping unit on a little enlarged scale than that in FIGS. 20 and 22.

In the ninth embedment shown in FIG. 23, a pair of slopes 27*a* and 27*b* is dented like a circular arc.

According to the structure shown in FIG. 23, a ridgeline can be eliminated on the boundary between a seal member 22 and the slopes 27*a* and 27*b* and at the initial stage at which ink starts to flow into an ink discharge port 24, the ink flows on the steep slope and thus can be led rapidly toward the ink discharge port 24 without ink cutoff or leaving a part of ink on the slope.

In the tenth embodiment shown in FIG. 24, a seal member 22 is formed communicating in a holder 21 forming a part of the capping unit 9 and further the seal member 22 is molded so as to project to an opening of the holder 21 as in the embodiment previously described with reference to FIGS. 18 to 23.

In the cross-sectional state shown in FIG. 24, the holder 21 is shown in a state in which the inner bottom face of the holder 21 and the portion forming the outside thereof are separate, but the inner bottom face and the outside portion are joined in a part not appearing in the figure. An outer shell member 31 is molded of a synthetic resin on the peripheral walls and the bottom wall of the outside portion of the holder 21 so that the holder 21 and the outer shell member 31 are molded in one piece.

In FIG. 24, a dashed line is inserted between the holder 21 and the outer shell member 31 for convenience of the description so that the holder 21 and the outer shell member 31 can be distinguished from each other; the holder 21 and the outer shell member 31 are molded in one piece and thus originally the dashed line does not exist in the cross-sectional view of FIG. 24.

Using a two-color molding method, first the holder 21 and the outer shell member 31 are molded in one piece with a primary metal mold (not shown), then the seal member 22 is molded between the holder 21 and a secondary metal mold (not shown), whereby the structure of the capping unit 9 shown in FIG. 24 can be provided.

According to the structure shown in FIG. 24, the holder 21 and the outer shell member 31 are molded in one piece, so that it is made possible not only to reduce the number of steps assembling the holder and outer shell member as in the related art, but also to occurrence of a defect at the assembling time can be eliminated, so that the reliability of the capping unit 9 can be enhanced and the number of parts can be decreased for reducing the costs.

Also in the ninth and tenth embodiments previously described with reference to FIGS. 23 and 24, preferably mirror finish and water-repellent treatment are applied to at least a pair of slopes 27*a* and 27*b*. In doing so, the phenomenon in which ink drops are left like several islands in the capping unit 9 does not occur and the ink can be discharged so that the remaining amount becomes zero or so.

According to the seventh to tenth embodiments of the invention, the ink discharge port communicating with the negative pressure generator is formed at the bottom of the internal space of the capping unit and the ink leader for producing the capillary action on ink discharged from the recording head and leading ink in the internal space to the ink discharge port is formed, so that the ink in the capping unit can be led to the ink discharge port by the capillary action and can be discharged instantly by the negative pressure generator.

In addition, the holder forming at least the inner bottom face of the capping unit and the seal member capable of sealing the recording head are formed of different materials, thus occurrence of bubbles caused by the surface tension of ink can be decreased because the holder and the seal member differ in interfacial state, and the degree of occurrence of a print failure caused by occurrence of a bubble can be decreased.

Figure 25:
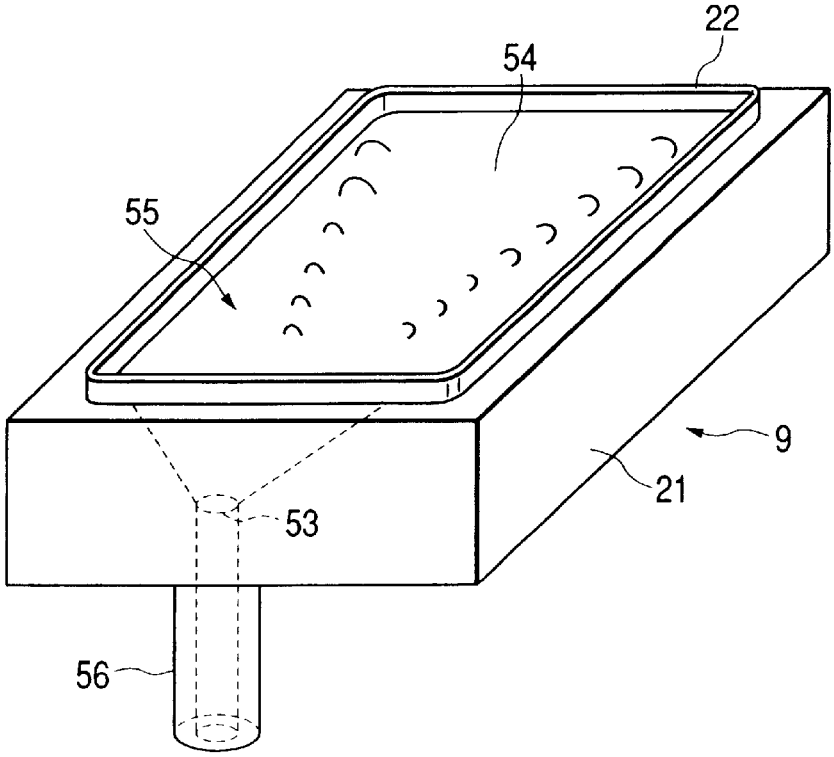
FIG. 25 is a perspective view to show a capping unit according to an eleventh embodiment of the invention.
Figure 26:
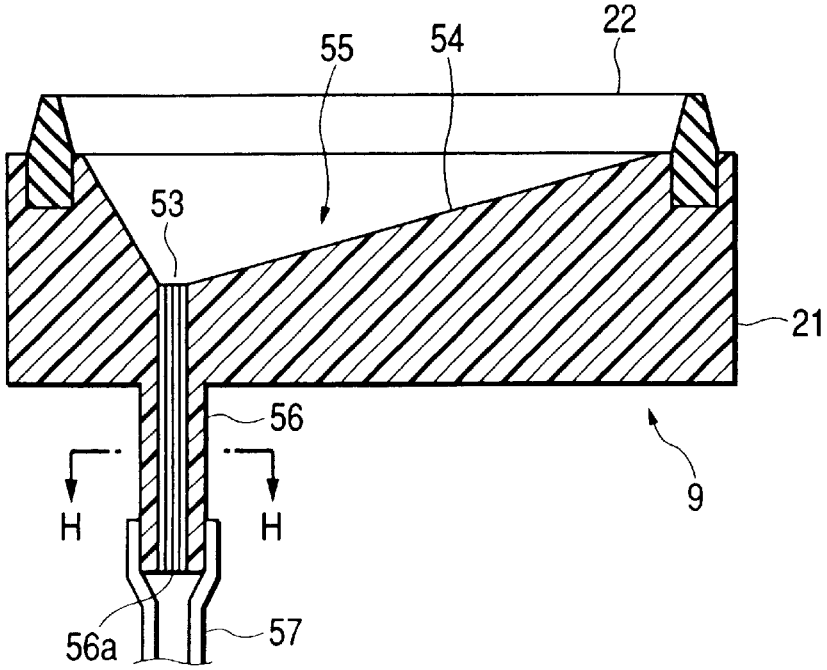
FIG. 26 is a longitudinal sectional view of the capping unit shown in FIG. 25.
Figure 27:
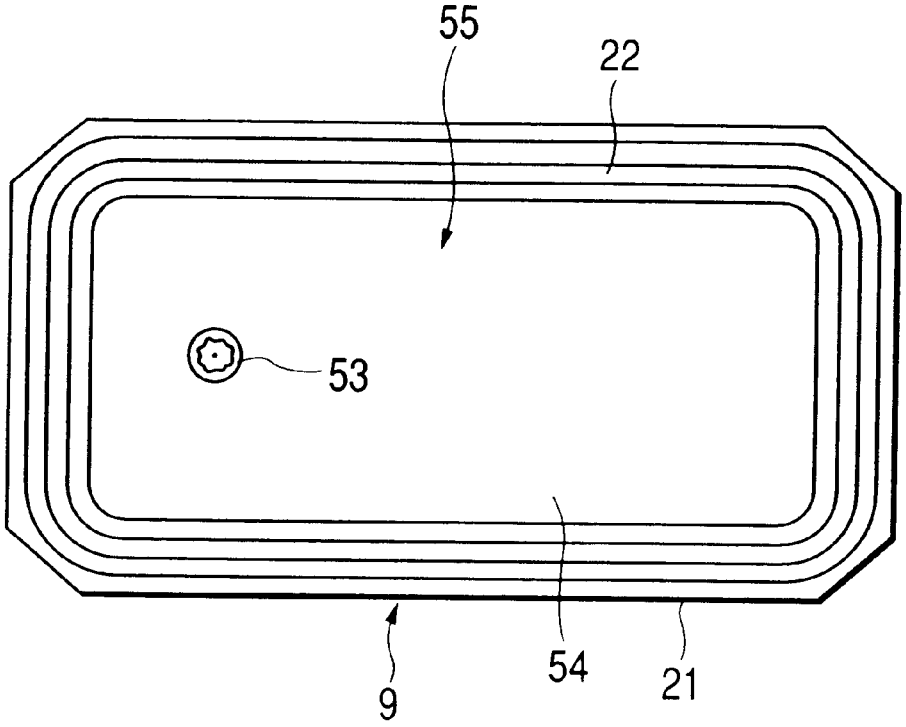
FIG. 27 is a plan view of the capping unit shown in FIG. 25.
Figure 28:
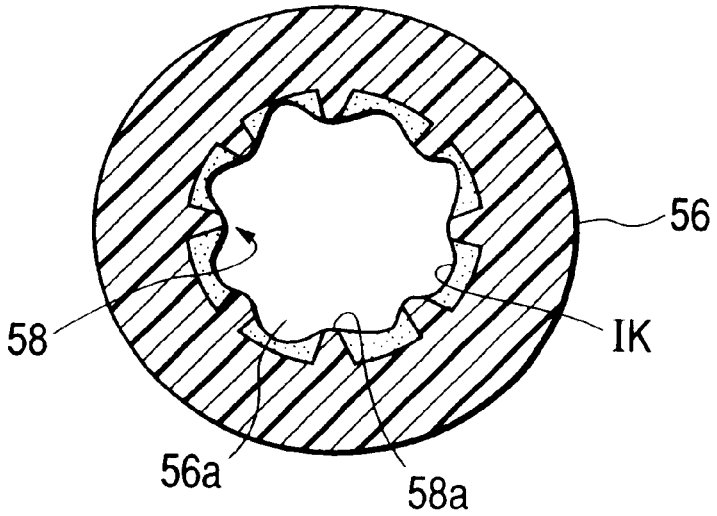
FIG. 28 is an enlarged sectional view taken on line H—H in arrow direction in FIG. 26.

FIGS. 25 to 28 show a capping unit according to an eleventh embodiment of the invention. FIG. 25 is a perspective view of the capping unit and FIG. 26 is a longitudinal sectional view of the capping unit. FIG. 27 is a plan view of the capping unit from the top face and FIG. 28 is an enlarged sectional view taken on line H—H in arrow direction in FIG. 26.

As shown in FIG. 25, the capping unit 9 is made up of a holder 21 formed almost like a rectangular parallelepiped and a cap member 22 of a rubber material, etc., having an end face formed almost like a square, the cap member 22 being placed on the top face of the holder 21.

The cap member 22 is attached to the holder 21 in a state in which it is buried along the margins of the top face of the holder 21 as shown in FIG. 26. The cap member 22 is identical with the cap member 9*d* previously described with reference to FIG. 2. The cap member 22 forms an opening for sealing a nozzle formation face 12 of a recording head 12.

On the other hand, the holder 21 is molded of a synthetic resin, for example, and is formed with a taper-like space 55 having a slope 54 shrunk continuously from an opening made in the cap member 22 to an ink discharge port 53 for guiding ink in the capping unit 9 into the ink discharge port 53.

On the bottom face of the holder 21 formed with the ink discharge port 53, a suction pipe 56 is molded integrally with the holder 21 and the ink discharge port 53 is made to communicate with a pipe line 56*a* formed in the suction pipe 56. A tube 57 is connected to a lower end part of the suction pipe 56 and is connected to the suction pump 56 as negative pressure generator.

The pipe line 56*a* formed in the suction pipe 56 is provided with a liquid retainer 58 capable of retaining liquid (ink) by capillary action as shown in FIG. 28 (enlarged sectional view).

In the embodiment shown in FIG. 28, the liquid retainer 58 is made up of a plurality of projection ribs 58*a* projecting toward the center of the pipe line 56*a*. As schematically shown in FIG. 28, ink IK is held by capillary action between the adjacent projection ribs 58*a* in the presence of the plurality of projection ribs 58*a*.

In the embodiment shown in FIG. 28, eight projection ribs 58*a* of the same shape are spaced almost equally from each other along the length direction of the pipe line 56*a*; the number of the projection ribs 58*a* is set appropriately in response to the requirements of the inner diameter of the pipe line 56*a*, the height of the projection rib 58*a*, etc.

Preferably, water-repellent treatment is applied to the surface of the slope 54 formed from the opening in the capping unit 9 to the ink discharge port 53.

By applying water-repellent treatment to the slope 54, if ink is discharged from the recording head 12 into the capping unit 9 as described later, it does not stick to the slope 54 to which water-repellent treatment is applied, and smoothly moves to the ink discharge port 53 as the ink is made spherical by the surface tension.

As means for applying the water-repellent treatment, the means covered in the description of the recording apparatus according to the first to third embodiments can be used intact. That is, using a high water-repellent material as the material of the holder 21 or conducting post-treatment particularly for the slope 54 of the holder 21, for example, with a fluorine-containing polymer can be named. It is also effective to apply water-repellent treatment to the cap member 22.

On the other hand, preferably hydrophilic treatment is applied to the liquid retainer 58 formed of a plurality of projection ribs 58*a*, namely, the surface in the pipe line 56*a* of the suction pipe 56.

Hydrophilic treatment is applied to the liquid retainer 58, whereby a phenomenon in which ink aggressively sticks to the corresponding part occurs as shown in FIG. 28 and the holding effect of ink by capillary action can be more increased.

As an example of applying the hydrophilic treatment, the surface is activated by UV application, plasma application and high-temperature aging is executed with a high-wettability dye liquid, whereby a wet component can be adsorbed onto the surface forming the liquid retainer 58, so that an affinity for water can be provided.

In the described structure, the nozzle formation face 12*a* of the recording head 12 is sealed with the capping unit 9 and the suction pump 10 as negative pressure generator is driven, whereby ink can be sucked and discharged from the recording head 12.

The suction operation is executed in a state in which sealing the recording head 12 with the capping unit 9 is released, whereby the ink in the capping unit 9 is moved from the slope 54 to the ink discharge port 53. The suction operation is further continued, whereby the ink is discharged to the outside without leaving the ink in the ink discharge port 53.

Thus, the problem of accumulating a humectant contained in the ink at a high density in the capping unit with the passage of time can be solved.

On the other hand, the flushing operation of jetting a predetermined amount of ink from the recording head 12 into the capping unit 9 is executed just before the capping operation wherein the recording apparatus enters a suspend mode.

In this case, according to the structure adopting the capping unit previously descried with reference to FIGS. 25 to 28, ink drops jetted from the recording head 12 are jetted toward the slope 54 in the capping unit 9 and are received on the slope 54.

Since water-repellent treatment is applied to the slope 54 and the slope 54 is formed so as to be continuously shrunk toward the ink discharge port 53 as descried above, each ink drop moves to the ink discharge port 53 placed in the gravity direction as it is made like a ball by the surface tension. The ink led to the ink discharge port 53 is held in the liquid retainer 58 formed of the plurality of projection ribs 58*a*.

In this case, the ink holding capability can be more enhanced by applying hydrophilic treatment to the liquid retainer 58 as described above. In this case, ink having a comparatively large water content jetted from the recording head 12 is held by the liquid retainer 58, so that the water content in the ink maintains the internal space of the capping unit 9 at high humidity and therefore the degree to an increase in viscosity of ink or hardening of ink in nozzle orifices can be decreased efficiently.

Figure 29:
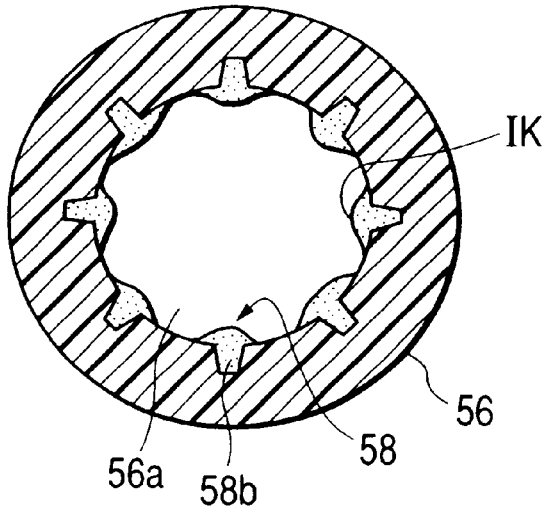
FIG. 29 is a partially enlarged sectional view to show a capping unit according to a twelfth embodiment of the invention.

Next, FIG. 29 shows a capping unit according to a twelfth embodiment of the invention. FIG. 29 is an enlarged sectional view of a suction pipe 56 and corresponds to FIG. 28 in the first embodiment.

The forms, etc., of a holder 21, a cap member 22, and a slope 54 formed in the holder 21 in the embodiment are similar to those in the eleventh embodiment previously described with reference to FIGS. 25 to 27.

As shown in FIG. 29, a pipe line 56a formed in the suction pipe 56 is provided with a liquid retainer 58 capable of holding liquid (ink) by capillary action as shown in FIG. 28 (enlarged sectional view).

In the embodiment shown in FIG. 29, the liquid retainer 58 is made up of a plurality of grooves 58*b* formed along the inner face of the pipe line 56*a*. As schematically shown in FIG. 29, ink IK is held by capillary action in the grooves 58*b* in the presence of the plurality of grooves 58*b*.

In the embodiment shown in FIG. 29, eight grooves 58*b* of the same shape are spaced almost equally from each other along the length direction of the pipe line 56*a*; the number of the grooves 58*b* is set appropriately in response to the requirements of the inner diameter of the pipe line 56*a*, the depth of the groove 58*b*, etc.

Since the ink holding capability can be more enhanced by applying hydrophilic treatment to the inside of the pipe line 56*a* in which the groves 58*b* are formed in a similar manner to that described above, the water content in the ink maintains the internal space of the capping unit 9 at high humidity and the degree to an increase in viscosity of ink or hardening of ink in nozzle orifices can be decreased efficiently.

Figure 30:
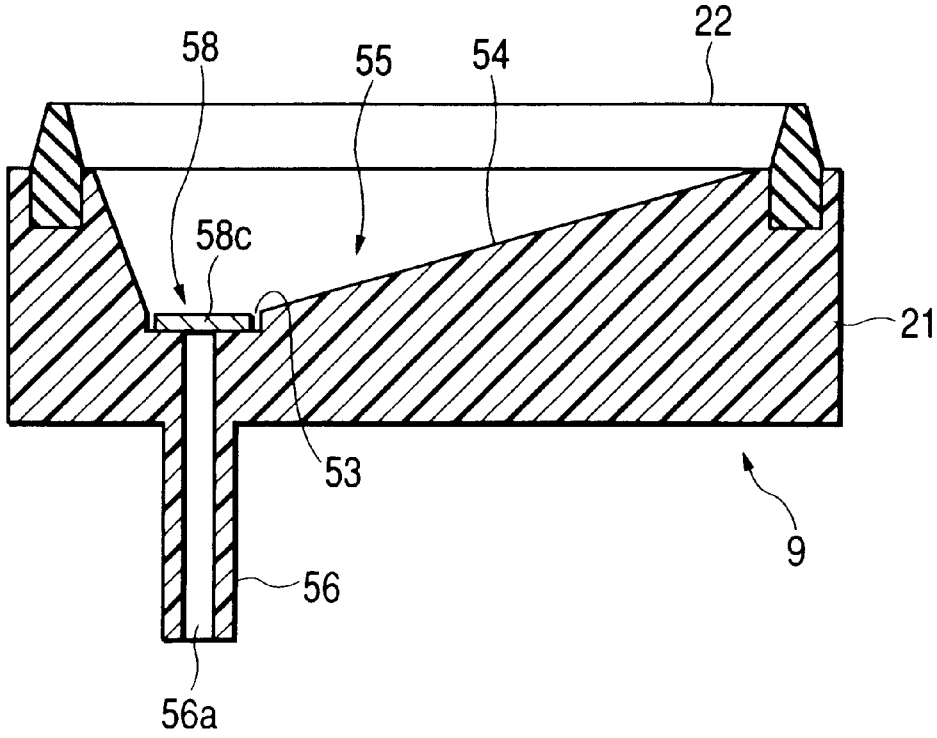
FIG. 30 is a longitudinal sectional view to show a capping unit according to a thirteenth embodiment of the invention.

Next, FIG. 30 shows a capping unit according to a thirteenth embodiment of the invention. FIG. 30 is a longitudinal sectional view of the capping unit 9 and corresponds to FIG. 26 in the first embodiment.

The forms, etc., of a holder 21, a cap member 22, and a slope 54 formed in the holder 21 in the embodiment are similar to those in the eleventh embodiment previously described with reference to FIGS. 25 to 27, and parts identical with or similar to those previously described with reference to FIGS. 25 to 27 are denoted by the same reference numerals in FIG. 30.

In the embodiment shown in FIG. 30, a liquid absorption member 58*c* as the liquid retainer 58 is placed in a communication part between an ink discharge port 53 and a pipe line 56*a*. The liquid absorption member 58*c* comprises a material having a large number of minute holes formed like a sheet and liquid (ink) is absorbed and held in the minute holes.

Preferably, the liquid absorption member 58*c* is formed of a porous foam; for example, nonwoven cloth provided by integrating long fiber of rayon, polyester, etc., can also be used. A metal filter into which metal fiber is finely weaved may also be used.

Preferably, hydrophilic treatment similar to that described above is applied to the sheet-like liquid absorption member 58*c* which is a porous foam, nonwoven cloth, or a metal filter; the liquid (ink) holding capability in the minute holes or minute spaces formed between the fibers can be enhanced by applying the hydrophilic treatment to the liquid absorption member 58c.

Water-repellent treatment is applied to a slope 54 formed in the holder 21 and therefore ink can be led to the ink discharge port 53 without leaving the ink on the slope 54.

Since ink having a comparatively large water content jetted from a recording head by the flushing operation is held in the sheet-like liquid absorption member 58*c* forming the liquid retainer 58, the water content in the ink can maintain the internal space of the capping unit 9 at high humidity.

Figure 31:
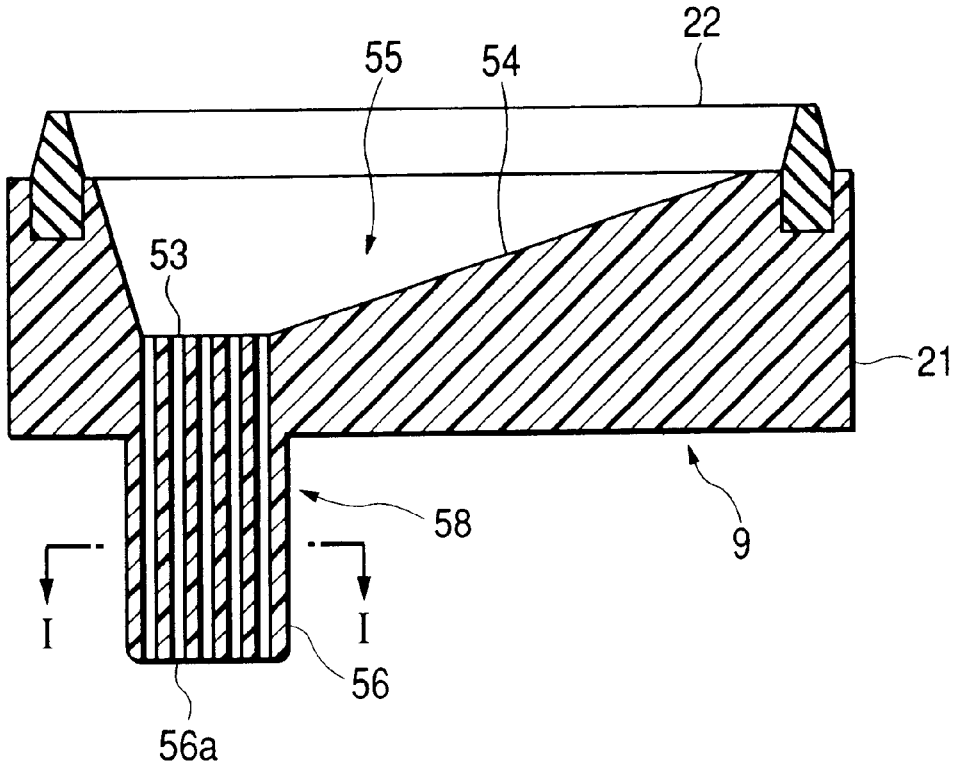
FIG. 31 is a longitudinal sectional view to show a capping unit according to a fourteenth embodiment of the invention.
Figure 32:
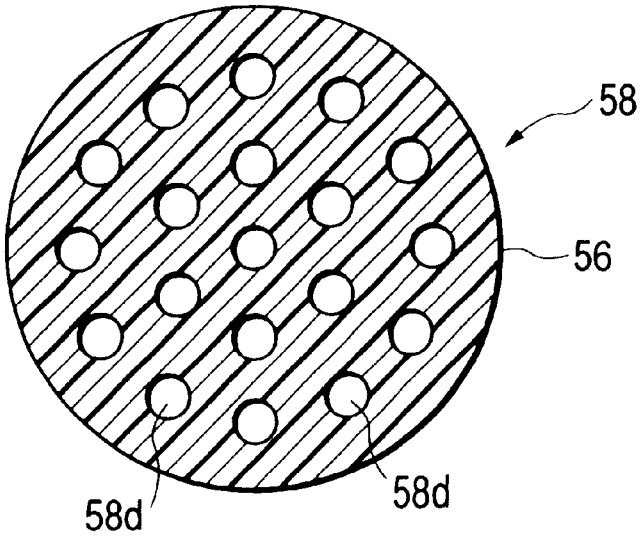
FIG. 32 is an enlarged sectional view taken on line I—I in arrow direction in FIG. 31.
Figure 33:
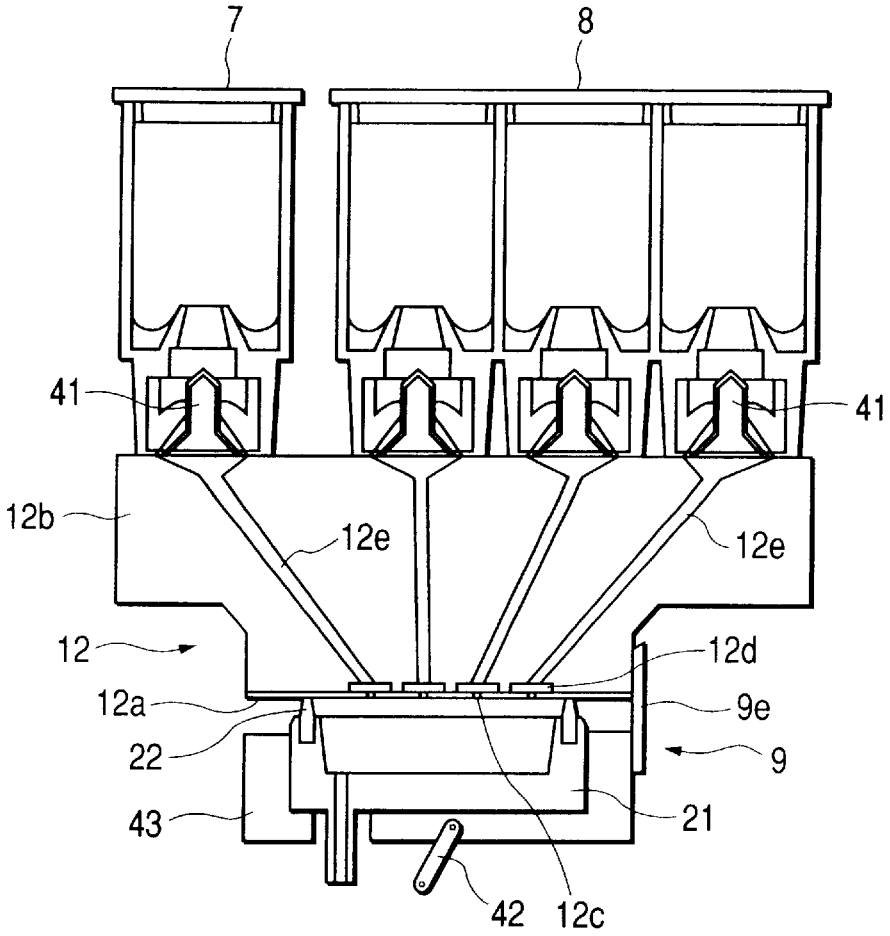
FIG. 33 is a longitudinal sectional view to show a capped state of a recording head.
Figure 34:
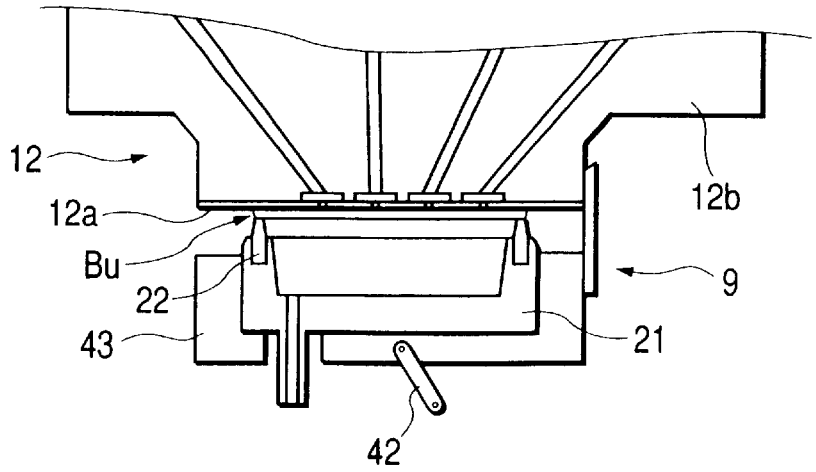
FIG. 34 is a longitudinal sectional view to show a state in which sealing is slightly released from the capped state shown in FIG. 33.
Figure 35:
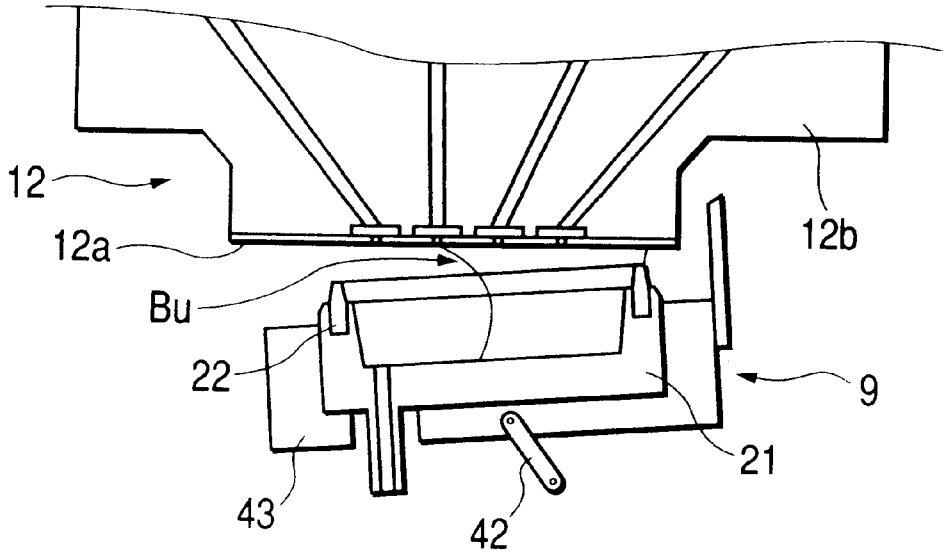
FIG. 35 is a longitudinal sectional view to show a state in which further a capping unit is moved down from the state shown in FIG. 34.

Next, FIGS. 31 and 32 show a capping unit according to a fourteenth embodiment of the invention. FIG. 31 is a longitudinal sectional view of the capping unit 9 and corresponds to FIG. 26 in the first embodiment. FIG. 32 is an enlarged sectional view taken on line I—I in arrow direction in FIG. 31.

The forms, etc., of a holder 21, a cap member 22, and a slope 54 formed in the holder 21 in the embodiment are similar to those in the eleventh embodiment previously described with reference to FIGS. 25 to 27, and parts identical with or similar to those previously described with reference to FIGS. 25 to 27 are denoted by the same reference numerals in FIGS. 31 and 32.

In the embodiment shown in FIGS. 31 and 32, a liquid retainer 58 is made up of a plurality of thin pipes 58*d* separately formed along a pipe line for holding liquid (ink) by capillary action in the thin pipes 58*d*. The number of the thin pipes 58*d* and the inner diameter of each thin pipe 58*d* are not limited to those illustrated in FIG. 32 and can be selected appropriately.

Hydrophilic treatment is applied to the inner surface of each thin pipe 58*d*, thereby enhancing the ink holding capability of each thin pipe 58*d*; advantages similar to those in the first to third embodiments can be provided.

As seen in the description made so far, the capping unit in the recording apparatus according to the eleventh to fourteenth embodiments of the invention is formed with the taper-like space having the slope shrunk continuously from the opening to the ink discharge port for guiding ink in the capping unit into the ink discharge port and comprises the liquid retainer capable of holding liquid by capillary action, placed in the pipe line communicating with the negative pressure generator from the ink discharge port, so that ink is reliably discharged at the suction operation time and when the capping unit is replenished with ink by performing the flushing operation, the ink is led to the ink discharge port along the slope without accumulating on the inner face of the capping unit.

The a liquid retainer placed in the pipe line communicating with the negative pressure generator from the ink discharge port holds the ink. Therefore, the problem of accumulating a humectant contained in the ink at a high density in the internal space of the capping unit can be solved.

The water content contained in the ink held by the liquid retainer placed in the pipe line can maintain the internal space of the capping unit at high humidity and it is made possible to efficiently suppress evaporation of ink in nozzle orifices.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An ink jet recording apparatus comprising:

a recording head having a nozzle formation face provided with nozzle orifices from which ink drops are jetted to print on a recording medium in accordance with print data;

a capping unit having an internal space communicated with a negative pressure generator, and having an opening for sealing the nozzle formation face and sucking ink from the nozzle orifices into the internal space by negative pressure generated by the negative pressure generator;

an ink discharge port formed on a bottom portion of the internal space of the capping unit;

an ink leader provided in the capping unit so as to generate capillary action to lead the sucked ink toward the ink discharge port; and a controller for causing the negative pressure generator to apply the negative pressure to the ink discharge port in order to:

(1) suck a first amount of ink from the nozzle orifices when the capping unit seals the nozzle formation face;

(2) suck ink remaining in the internal space when the capping unit is apart from the nozzle formation face;

(3) suck a second amount of ink, which is smaller than the first amount, from the nozzle orifices when the capping unit again seals the nozzle formation face.

2. The ink jet recording apparatus as set forth in claim 1, wherein the capping unit is separated from the nozzle formation face in an unparallel attitude with respect to the nozzle formation face in accordance with a predetermined movement of the recording head; and wherein the ink discharge port is placed at an end portion of the bottom portion of the internal space which is closer to the nozzle formation face when the capping unit starts to be separated from the nozzle formation face.

3. The ink jet recording apparatus as set forth in claim 1, wherein the capping unit is separated from the nozzle formation face in a parallel attitude with respect to the nozzle formation face in accordance with a predetermined movement of the recording head; and wherein a pair of ink discharge ports are placed at both end portions of the bottom portion of the internal space.

4. An ink jet recording apparatus comprising:

a recording head having a nozzle formation face provided with nozzle orifices from which ink drops are jetted to print on a recording medium in accordance with print data;

a capping unit having an internal space communicated with a negative pressure generator, and having an opening for sealing the nozzle formation face and sucking ink from the nozzle orifices into the internal space by negative pressure generated by the negative pressure generator;

an ink discharge port formed on a bottom portion of the internal space of the capping unit;

an ink leader provided in the capping unit so as to generate capillary action to lead the sucked ink toward the ink discharge port; and a projection for breaking bubbles appearing due to surface tension of an ink solvent.

5. The ink jet recording apparatus as set forth in claim 4, wherein the opening of the capping unit is formed into a rectangular shape;

wherein a pair of slopes are formed in the internal space so as to extend from the opening toward the bottom portion such that a valley line defined as an intersection of the slopes extends in a longitudinal direction of the rectangular opening; and wherein the projection is formed on each of the slopes.

6. An ink jet recording apparatus comprising:

a recording head having a nozzle formation face provided with nozzle orifices from which ink drops are jetted to print on a recording medium in accordance with print data;

a capping unit having an internal space communicated with a negative pressure generator, and having an opening for sealing the nozzle formation face and sucking ink from the nozzle orifices into the internal space by negative pressure generated by the negative pressure generator;

an ink discharge port formed on a bottom portion of the internal space of the capping unit; and an ink leader provided in the capping unit so as to generate capillary action to lead the sucked ink toward the ink discharge port;

wherein a pair of slopes are formed in the internal space so as to extend from toward the bottom portion;

wherein the ink leader is provided as a valley line defined as an intersection of the slopes;

wherein the ink discharge port is formed on a part of the valley line; and wherein a cross section of the slopes is curved.

7. An ink jet recording apparatus comprising:

a recording head having a nozzle formation face provided with nozzle orifices from which ink drops are jetted to print on a recording medium in accordance with print data;

a capping unit having an internal space communicated with a negative pressure generator, and having an opening for sealing the nozzle formation face and sucking ink from the nozzle orifices into the internal space by negative pressure generated by the negative pressure generator;

an ink discharge port formed on a bottom portion of the internal space of the capping unit; and an ink leader provided in the capping unit so as to generate capillary action to lead the sucked ink toward the ink discharge port, wherein a surface roughness of the bottom portion of the internal space is 25 $\mu$m or less.

8. An ink jet recording apparatus comprising:

a recording head having a nozzle formation face provided with nozzle orifices from which ink drops are jetted to print on a recording medium in accordance with print data;

a capping unit having an internal space communicated with a negative pressure generator, and having an opening for sealing the nozzle formation face and sucking ink from the nozzle orifices into the internal space by negative pressure generated by the negative pressure generator;

an ink discharge port formed on a bottom portion of the internal space of the capping unit; and an ink leader provided in the capping unit so as to generate capillary action to lead the sucked ink toward the ink discharge port;

wherein the ink leader includes a slope continuously extending from the opening to the ink discharge port, and a liquid retainer formed on a communication path between the ink discharge port and the negative pressure generator.

9. The ink jet recording apparatus as set forth in claim 8, wherein the liquid retainer is provided as a plurality of ribs protruded from an inner face of the communication path.

10. The ink jet recording apparatus as set forth in claim 8, wherein the liquid retainer is provided as a plurality of grooves formed on an inner face of the communication path.

11. The ink jet recording apparatus as set forth in claim 8, wherein the liquid retainer is provided as a liquid absorbing member provided at a connecting portion of the ink discharge port and the communication path.

12. The ink jet recording apparatus as set forth in claim 8, wherein the liquid retainer is provided as a plurality of thin tubes formed in the communication path so as to extend therealong.

13. The ink jet recording apparatus as set forth in claim 8, wherein hydrophilic treatment is applied to the liquid retainer.

14. A method of discharging ink, comprising:

providing an ink jet recording apparatus including: a recording head having a nozzle formation face provided with nozzle orifices from which ink drops are jetted; and a capping unit having an internal space communicated with a negative pressure generator and formed with an ink discharge port;

sealing the nozzle formation face with the capping unit;

driving the negative pressure generator to suck ink from the nozzle orifice into the internal space of the capping unit;

separating the capping unit from the nozzle formation face, and driving the negative pressure generator to discharge the sucked ink from the ink discharge port such that a discharging speed is controlled to such an extent that no suction vortex appears in the sucked ink.

15. A method of discharging ink, comprising:

providing an ink jet recording apparatus including: a recording head having a nozzle formation face provided with nozzle orifices from which ink drops are jetted; and a capping unit having an internal space communicated with a negative pressure generator and formed with an ink discharge port;

sealing the nozzle formation face with the capping unit;

driving the negative pressure generator to suck a first amount of ink from the nozzle orifice into the internal space of the capping unit;

separating the capping unit from the nozzle formation face;

driving the negative pressure generator to discharge the sucked ink from the internal space of the capping unit;

sealing again the nozzle formation face with the capping unit; and driving the negative pressure generator to suck a second amount of ink, which is smaller than the first amount, from the nozzle orifice in order to restore a meniscus of ink in each of the nozzle orifices.

* * * * *